US005538842A

United States Patent [19]

Takahashi et al.

[11] Patent Number: 5,538,842

[45] Date of Patent: Jul. 23, 1996

[54] SILVER HALIDE COLOR PHOTOGRAPHIC LIGHT-SENSITIVE MATERIAL

[75] Inventors: Osamu Takahashi; Takehiko Sato, both of Kanagawa, Japan

[73] Assignee: Fuji Photo Film Co., Ltd., Kanagawa, Japan

[21] Appl. No.: 268,976

[22] Filed: Jun. 30, 1994

[30] Foreign Application Priority Data

Jul. 2, 1993 [JP] Japan ..... 5-188685

[51] Int. Cl.[6] ..... G03C 1/08; G03C 7/26; G03C 7/32

[52] U.S. Cl. ..... 430/549; 430/543; 430/558; 430/548; 430/551; 430/372; 430/567; 430/502; 430/512; 430/931; 430/386; 430/387

[58] Field of Search ..... 430/543, 558, 430/386, 387, 548, 551, 372, 567, 505, 502, 512, 931, 549

[56] References Cited

U.S. PATENT DOCUMENTS

| | | | |
|---|---|---|---|
| 3,061,432 | 10/1962 | Menzel et al. | 430/376 |
| 3,698,907 | 10/1972 | Sato et al. | 430/502 |
| 4,500,630 | 2/1985 | Sato et al. | 430/386 |
| 5,104,782 | 4/1992 | Seto et al. | 430/551 |
| 5,122,444 | 6/1992 | Sakai | 430/505 |

FOREIGN PATENT DOCUMENTS

| | | |
|---|---|---|
| 57-1959A2 | 12/1993 | European Pat. Off. . |
| 52-72225 | 6/1977 | Japan . |
| 234838 | 2/1990 | Japan . |
| 1529908 | 10/1978 | United Kingdom . |

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

There is disclosed a silver halide color photographic light-sensitive material which excels in a color reproduction and a light fastness at a low density part through a high density part and which is improved in a Y-stain at a background part. The silver halide color photographic light-sensitive material comprises a support and provided thereon at least one photographic constitutional layer, wherein at least one layer of the above photographic constitutional layers contains at least one of the compounds represented by the following Formula (I) and a compound represented by the following Formula (II) in the same layer:

Formula (I)

wherein R represents a hydrogen atom or a substituent; $Z_a$, $Z_b$, and $Z_c$ each represent any group of methine, substituted methine, =N—, or —NH—; Y represents a hydrogen atom or a group capable of splitting off upon a coupling reaction with an oxidation product of a developing agent; provided that a dimer or a polymer may be formed via R, Y, or $Z_a$, $Z_b$ or $Z_c$ when each is a substituted methine:

Formula (II)

wherein X and Y each represent a hydrogen atom, an alkyl group, an alkoxy group, or an acyl group; Z represents —CO— or —COO—; and m, l and p each represent an integer of 1 to 4.

10 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material having an excellent color reproducibility, a high light-fastness and an improved yellow stain.

BACKGROUND OF THE INVENTION

In general, a color image which is obtained by processing a silver halide color photographic light-sensitive material comprises an azomethine dye or an indoaniline dye which is formed by a reaction of an oxidation product of an aromatic primary amine developing agent with a coupler.

A vivid dye having less sub-absorption is required in order to obtain a color photographic image having a good color reproduction. Since a dye which is formed from a 5-pyrazolone series magenta coupler which is widely used for forming a magenta dye has a sub-absorption in the vicinity of 430 nm other than a primary absorption in the vicinity of 550 nm, it is not preferred in terms of a color reproduction and various researches have been made in order to solve this.

In particular, in the dyes which are formed from the pyrazoloazole series magenta couplers described in U.S. Pat. Nos. 3,061,432 and 4,500,630, the sub-absorptions in the vicinity of 430 nm are notably decreased as compared with those of the dyes formed from a 5-pyrazolone series magenta coupler, and therefore they are preferred in terms of a color reproduction.

Further, they have a very little Y-stain at a non-color developing part generated due to heat and humidity and have a preferable advantage.

However, the following two points are required to be improved because of the insufficient performances in the above couplers. That is, one is that a light fastness at a low density color developing part is markedly inferior as compared with that at a high density color developing part and the other is that a Y-stain is generated due to light at a background part which is a non-exposed part. Thus, the different fading rates at a low density part and a high density part or generation of the Y-stain at a non-exposed part markedly reduce a commercial value as a photographic material. Particularly in recent years, a storing condition of a photo has been diversified. In particular, since a display factor has been increasing, a dye in which the Y-stain is not generated by irradiation of light and which is fast regardless of a color developing density has strongly been desired.

Use of bisphenols is proposed in, for example, JP-A-52-7222 (the term "JP-A" as used herein means an unexamined published Japanese patent application) as a method for improving the generation of the above Y-stain due to light.

They certainly reveal an effect to a 3-anilino-5-pyrazolone type magenta coupler. However, in the case where they are applied to the magenta couplers of pyrazolotriazoles described above, not only a Y-stain controlling effect is not given but also the Y-stain is inversely increased in some cases.

A 2-(2'-hydroxyphenyl)benzotriazole series compound and a benzophenone series compound which are UV absorbers were added to an intermediate layer or a silver halide emulsion layer which were provided above a magenta coupler-containing layer, and there was observed a little improvement in a light fastness at the low density color developing part described above and suppression of the Y-stain, which were attributable to a UV ray cut action. However, even increase in the addition amount thereof limited the effect obtained.

SUMMARY OF THE INVENTION

The present invention has been made taking the problems described above into consideration. The object of the present invention is to provide a silver halide color photographic light-sensitive material which excels in a color reproduction and a light fastness at a low density part through a high density part and which is improved in a yellow stain (hereinafter referred to as a Y-stain) at a white background part.

The above objects have been attained by the following:

A silver halide color photographic light-sensitive material comprising a support and provided thereon at least one photographic constitutional layer, wherein at least one layer of the above photographic constitutional layers contains a coupler represented by the following Formula (I) and a compound represented by the following Formula (II) in the same layer:

Formula (I)

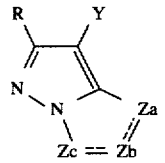

wherein R represents a hydrogen atom or a substituent; $Z_a$, $Z_b$, and $Z_c$ each represent any group of methine, substituted methine, =N—, or —NH—; Y represents a hydrogen atom or a group capable of splitting off upon a coupling reaction with an oxidation product of a developing agent; provided that a dimer or a polymer may be formed via R, Y or $Z_a$, $Z_b$ or $Z_c$ when each is a substituted methine:

Formula (II)

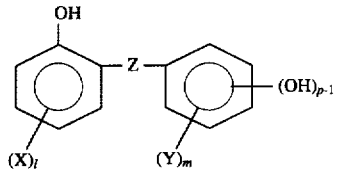

wherein X and Y each represent a hydrogen atom, an alkyl group, an alkoxy group, or an acyl group; Z represents —CO—or —COO—; and m, l and p each represent an integer of 1 to 4.

DETAILED DESCRIPTION OF THE INVENTION

Of the couplers represented by Formula [I], preferred compounds are represented by Formulas (Ia), (Ib), (Ic), (Id) and (Ie):

Formula (Ia)

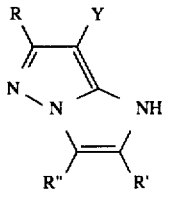

(Ia)

-continued

Formula (Ib)

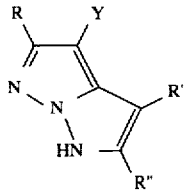

(Ib)

Formula (Ic)

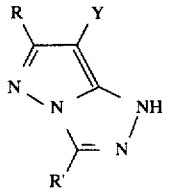

(Ic)

Formula (Id)

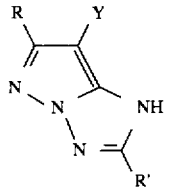

(Id)

Formula (Ie)

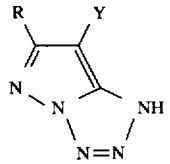

(Ie)

In the formulas (Ia) to (Ie), R represents a hydrogen atoms or a substituent; R' and R" each represent a hydrogen atom or a substituent, and Y represents a hydrogen atom or a group capable of splitting off upon a coupling reaction with an oxidation product of a developing agent, i.e., the same group as defined in Formula (I).

The substituents in the formula (I) and (Ia) to (Ie) will be explained in detail.

The substituents represented by R, R' and R" each represent an aliphatic group including a straight or branched alkyl group, a cycloalkyl group, an alkenyl group and preferably having 1 to 36 carbon atoms which include carbon atoms of substituent thereof; an aromatic group including a phenyl group, a naphthyl group; a heterocyclic group (for example, a nitrogen-containing 5- to 6- membered ring group), or a coupling splitting off group defined hereinafter. Of them, aliphatic group and aromatic group are preferred, and groups defined in Formula (If) are most preferred. These groups may further be substituted with the groups selected from an alkyl group, an aryl group, a heterocyclic group, an alkoxy group (for example, methoxy and 2-methoxyethoxy), an aryloxy (for example, 2,4-di-tert-amylphenoxy, 2-chlorophenoxy and 4-cyanophenoxy), an alkenyloxy group (for example, 2-propenyloxy), an acyl group (for example, acetyl and benzoyl), an ester group (for example, butoxycarbonyl, phenoxycarbonyl, acetoxy, benzoyloxy, butoxysulfonyl, and toluenesulfonyloxy), an amido group (for example, acetylamino, methanesulfonamido, and dipropylsulfamoylamino), a carbamoyl group (for example, dimethylcarbamoyl and ethylcarbamoyl), a sulfamoyl group (for example, butylsulfamoyl), an imido group (for example, succinimido and hydantoinyl), a ureido group (for example, phenylureido and dimethylureido), an aliphatic or aromatic sulfonyl group (for example, methanesulfonyl and phenylsulfonyl), an aliphatic or aromatic thio group (for example, ethylthio and phenylthio), a hydroxy group, a cyano group, a carboxy group, a nitro group, a sulfo group, and a halogen atom. R, R' and R" may further be R'"O—, R'"C(=O)—, R'"CO(=O)—, R'"S—, R'"SO—, R'"$SO_2$—, R'"$SO_2$NH—, R'"C(=O)NH—, R'"NH—, R'"OC(=O)NH—, a hydrogen atom, a halogen atom, a cyano group, and an imido group (R'" represents an alkyl group preferably having 1 to 36 carbon atoms, an aryl group or a heterocyclic group).

R, R' and R" may further be a carbamoyl group, a sulfamoyl group, a ureido group, or a sulfamoylamino group, and the hydrogen atoms on these groups may be substituted with the substituents which are allowed to R to R". Of them, preferred are a linear alkyl group, a branched alkyl group, an aryl group, an alkoxy group, an aryloxy group, and a ureido group.

Y represents the group defined in Formula (I). The substituent represented by Y is a group which is synonymous with R, R' and R".

A group capable of splitting off upon a coupling reaction with an oxidation product of a developing agent (hereinafter referred to as a coupling splitting-off group) represented by Y includes a group which is composed of a combination of a group such as an aliphatic group, an aromatic group, a heterocyclic group, an aliphatic, aromatic or heteroyclic sulfonyl group, an aliphatic or aromatic-oxycarbonyl group, an aliphatic or aromatic carbamoyl group, or an aliphatic, aromaric or heterocyclic carbonyl group or an imido group, and an atom such as an oxygen, nitrogen or sulfur atom which connects to a coupling active carbon atom; a halogen atom; or aromatic azo group. The aliphatic group, the aromatic group or the heterocyclic group each contained in these coupling splitting-off groups may be substituted with the substituents which are allowed to R to R".

To enumerate a concrete example of the coupling splitting-off group, it includes a halogen atom (for example, fluorine, chlorine and bromine), an alkoxy group (for example, ethoxy, dodecyloxy, methoxyethoxy, methoxyethylcarbamoyl, carboxypropyloxy, and methylsulfonylethoxy), an aryloxy group (for example, 4-chlorophenoxy, 4-methoxyphenoxy and 4-carboxyphenoxy), an acyloxy group (for example, acetoxy, tetradecanoyloxy and benzoyloxy), an aliphatic or aromatic sulfonyloxy group (for example, methanesulfonyloxy and toluenesulfonyloxy), an acylamino group (for example, dichloroacetylamino and heptafluorobutyrylamino), an aliphatic or aromatic sulfonamido group (for example, methanesulfonamido and p-toluenesulfonamido), an alkoxycarbonyloxy group (for example, ethoxycarbonyloxy and benzyloxycarbonyloxy), an aryloxycarbonyloxy group (for example, phenoxycarbonyloxy), an aliphatic, aromatic or heterocyclic thio group (for example, ethylthio, phenylthio and tetrazolylthio), a carbamoylamino group (for example, N-methylcarbamoylamino and N-phenylcarbamoylamino), a 5-membered or 6-membered nitrogen-containing heterocyclic group (for example, imidazolyl, pyrazolyl, triazolyl, tetrazolyl, and 1,2-dihydro-2-oxo-1-pyridyl), an imido group (for example, succinimido and hydantoinyl), and an aromtaic azo group (for example, phenylazo). The coupling slitting-off group in the present invention may contain a photographically useful group providing a property of a developing inhibitor, a developing accelerator, a desilvering accelerator and so on. Of them, a halogen atom and an arylthio group are particularly preferred.

Of the couplers represented by Formulas (Ia) to (Ie), those represented by Formulas (Ic) and (Id) are preferred in terms of the effect of the present invention.

Further preferred is a case in which R is a tertiary alkyl group in Formula (Ic) and Formula (Id).

In the present invention, of the couplers represented by Formula (I), the most preferred coupler is the coupler represented by the following Formula (If):

Formula (If)

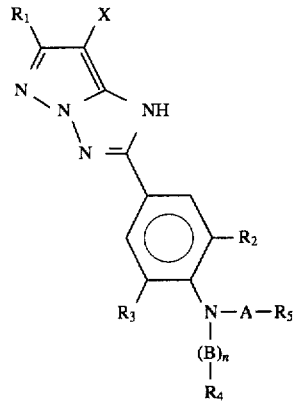

wherein $R_1$ represents a tertiary alkyl group; $R_2$ and $R_3$ each represent a hydrogen atom or a substituent; X represents a halogen atom or an aryloxy group; A and B each represent —CO—or —$SO_2$—; n represents 0 or 1; $R_4$ represents a hydrogen atom, an alkyl group or an aryl group; $R_5$ represents an alkyl group, an aryl group, an alkoxy group, an alkylamino group, or an arylamino group; and $R_4$ and $R_5$ may be combined with each other to form a 5-membered ring, a 6-membered ring or a 7-membered ring.

The coupler represented by Formula (If) will be explained in further detail.

$R_1$ represents a tertiary alkyl group, and the tertiary alkyl group has preferably 4 to 10 carbon atoms and more preferably 4 carbon atoms and may have a substituent. The branched alkyl groups may be combined with each other to form a ring. Preferred as the substituent therefor are, for example a halogen atom (for example, fluorine and chlorine), an alkoxy group (for example, methoxy, ethoxy and dodecyloxy), an arlyoxy group (for example, phenoxy, 2-methoxyphenoxy and 4-t-octylphenoxy), an alkylthio group (for example, methylthio, ethylthio, octylthio, and hexadecylthio), an arylthio group (for example, phenylthio, 2-pivaloylphenylthio, and 2-butoxy-5-t-octylphenylthio), an ester group (for example, methyl ester and ethyl ester), and a cyano group. $R_1$ in which the branched alkyl groups are combined with each other to form a ring includes 1-methylcyclopropyl, 1-ethylcyclopropyl and an adamantyl. Most preferred $R_1$ is t-butyl.

Preferred as the substituent represented by $R_2$ and $R_3$ are a cyano group, a hydroxy group, a carboxyl group, a halogen atom (for example, fluorine, chlorine and bromine), an alkyl group (for example, methyl, ethyl, propyl, butyl, and t-butyl), an aryl group (for example, phenyl), an alkoxy group (for example, methoxy, ethoxy, propyloxy, butoxy, and dodecyloxy), an aryloxy group (for example, phenoxy, 4-methoxyphenoxy, 2-methoxyphenoxy, 4-methylphenoxy, 4-chlorophenoxy, 4-tert-butylphenoxy, and 2,4-dimethylphenoxy), an alkoxycarbonyl group (for example, methoxycarbonyl, ethoxycarbonyl, octyloxycarbonyl, and hexadecyloxycarbonyl), a carbamoyl group (for example, N-ethylcarbamoyl, N-dodecylcarbamoyl, N,N-dibutylcarbamoyl, N-cyclohexylcarbamoyl, and N-phenylcarbamoyl), and a sulfamoyl group (for example, N-ethylsulfamoyl, N-butylsulfamoyl, N-octylsulfamoyl, N-hexadecylsulfamoyl, N-cyclohexylsulfamoyl, N,N-dibutylsulfamoyl, and N-methyl-N-octadecylsulfamoyl).

In the present invention, preferred is a case in which $R_2$ is a hydrogen atom and $R_3$ is a hydrogen atom, an alkyl group or an alkoxy group, and most preferred is a case in which both of $R_2$ and $R_3$ are hydrogen atoms.

$R_4$ represents a hydrogen atom, an alkyl group or an aryl group. The alkyl group represented by $R_4$ preferably has 1 to 36 carbon atoms and especially has a sufficient number of carbon atom to provide non-diffusibility to the coupler, and represents a substituted or non-substituted, linear or branched alkyl group. A substituent for the substituted alkyl group includes a halogen atom (for example, fluorine, chlorine and bromine), a hydroxy group, a cyano group, a carboxyl group, an aryl group (for example, phenyl and naphthyl), an alkoxy (for example, methoxy, ethoxy, propyloxy, butoxy, dodecyloxy, 2-methoxyethoxy, and 2-phenoxyethoxy), an aryloxy group (for example, phenoxy, 2-methoxyphenoxy, 4-methylphenoxy, 4-methoxyphenoxy, 2,4-dimethylphenoxy, 2,4-di-tert-amylphenoxy, 4-tert-octylphenoxy, 4-cyanophenoxy, 2-chloro-4-tert-octylphenoxy, and 4-methanesulfonamidophenoxy), an alkylthio group (for example, methylthio, ethylthio, butylthio, octylthio, dodecylthio, hexadecylthio, 2-ethylhexylthio, and 2-phenoxyethylthio), an arylthio group (for example, phenylthio, 2-pivaloylamidophenylthio, 4-tert-octylphenylthio, 4-dodecyloxyphenylthio, and 2-butoxy-4-tert-octylphenylthio), a alkoxycarbonyl group (for example, methoxycarbonyl, ethoxycarbonyl, propyloxycarbonyl, butoxycarbonyl, octyloxycarbonyl,dodecyloxycarbonyl,hexadecyloxycarbonyl, and 2-methoxyethoxycarbonyl), a carbonyloxy group (for example, acetyloxy, propionyloxy, dodecanoyloxy, and hexadecanoyloxy), an amido group (for example, acetoamido, propaneamido, butaneamido, dodecaneamido, hexadecaneamido, benzamido, and 2-dodecyloxybenzamido), a sulfonamido group (for example, methanesulfonamido, ethanesulfonamido, octhanesulfonamido, hexadecanesulfonamido, benzenesulfonamido, 2-octyloxy-4-tert-octylbenzenesulfonamido, 2-hexadecyloxycarbonylbenzenesulfonamido, 3-hexadecyloxycarbonylbenzenesulfonamido, and 3-dodecyloxycarbonylbenzenesulfonamido), a carbamoyl group (for example, N-methylcarbamoyl, N-butylcarbamoyl, N-cyclohexylcarbamoyl, N-dodecylcarbamoyl, N-phenylcarbamoyl, N,N-diethylcarbamoyl, and N,N-dibutylcarbamoyl), a sulfamoyl group (for example, N-ethylsulfamoyl, N-butylsulfamoyl, N-hexadecylsulfamoyl, N-cyclohexylsulfamoyl, N,N-dibutylsulfamoyl, N-phenylsulfamoyl, and N-methyl-N-octadecylsulfamoyl), an imido group (for example, succinimido, phthalimido, hexadecylsuccinimido, and octadecylsuccinimido), a urethane group (for example, methylurethane, ethylurethane, dodecylurethane, and phenylurethane), a ureido group (for example, N-methylureido, N-ethylureido, N-dodecylureido, N,N-dibutylureido, N-phenylureido, and N-cyclohexylureido), and a sulfonyl group (for example, methylsulfonyl, ethylsulfonyl, propylsulfonyl, butylsulfonyl, hexylsulfonyl, octylsulfonyl, dodecylsulfonyl, hexadecylsulfonyl, and phenylsulfonyl).

The aryl group represents a substituted or non-substituted aryl group, and a substituent for the substituted aryl group is synonymous with the substituent for the substituted alkyl group which was explained in the substituents $R_4$ and $R_1$ described above.

$R_5$ represents an alkyl group, an aryl group, an alkoxy group, an alkylamino group or an arylamino group. The alkyl group represented by $R_5$ represents a substituted or non-substituted, linear or branched alkyl group and preferably has a sufficient number of carbon atom to provide a non-diffusibility to the coupler. A substituent for the substituted alkyl group is synonymous with the substituent for the substituted alkyl group which was explained in substituted $R_4$ described above. The alkyl group is preferably a branched substituted or non-substituted alkyl group or a linear substituted alkyl group from a viewpoint of a solubility. The aryl group in $R_5$ represents a substituted or non-substituted aryl group, and a substituent for the substituted aryl group is synonymous with the substituent for the substituted alkyl group which was explained in substituted $R_4$ described above. The alkoxy group in $R_5$ represents a substituted or non-substituted, linear or branched alkoxy group, and a substituent for the substituted alkoxy group is synonymous with the substituent for the substituted alkyl group which was explained in substituted $R_4$ described above. The alkylamino group in $R_5$ represents a substituted or non-substituted, linear or branched alkylamino group, and a substituent for the substituted alkylamino group is synonymous with the substituent for the substituted alkyl group which was explained in substituted $R_4$ described above.

The arylamino group in $R_5$ represents a substituted or non-substituted arylamino group, and a substituent for the substituted arylamino group is synonymous with the substituent for the substituted alkyl group which was explained in substituted $R_4$ described above. A and B each represent —CO— or —$SO_2$—, and n represents 0 or 1. A is preferably —$SO_2$—.

$R_4$ and $R_5$ may be combined with each other to form a 5-membered ring, a 6-membered ring or a 7-membered ring. The representative examples of the 5-membered ring, the 6-membered ring and the 7-membered ring will be shown below but will not be limited thereto.

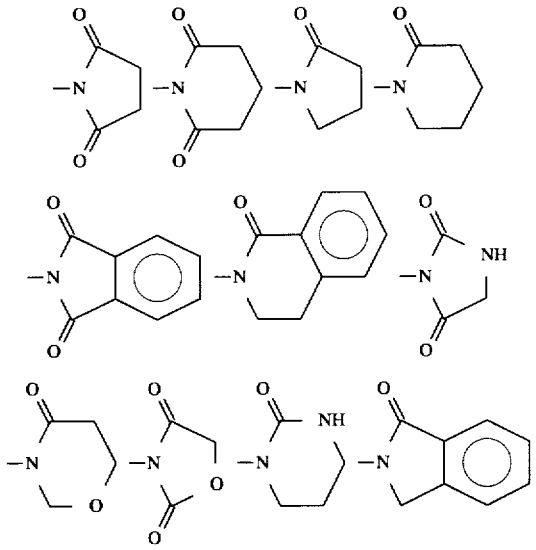

-continued

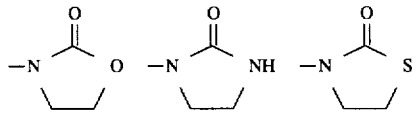

The 5-membered ring, the 6-membered ring and the 7-membered may have the substitutable substituents thereof, for example, the substituents explained in $R_2$ and $R_3$ described above, on the respective rings.

In the case where $R_4$ and $R_5$ are combined, an imide ring or a lactam ring is preferred, and a case in which $R_4$ and $R_5$ are not combined is more preferred. Most preferred is a case in which n is 0 and $R_4$ is a hydrogen atom.

X represents a halogen atom or an aryloxy group. In the coupler of the present invention, this X is split off upon a coupling reaction with an oxidation product of a developing agent. The halogen atom includes fluorine, chlorine and bromine. The aryloxy group represents a substituted or non-substituted aryloxy group, and a substituent for the substituted aryloxy group is synonymous with the substituent for the substituted alkyl group which was explained in substituted $R_4$ described above. There can be enumerated as the aryloxy group, phenoxy, 4-methylphenoxy, 4-tert-butylphenoxy, 4-methoxycarbonylphenoxy, 4-ethoxycarbonylphenoxy, 4-carboxyphenoxy, 4-cyanophenoxy, and 2,4-dimethylphenoxy.

Preferred X is a halogen atom, and the most preferred one is a chlorine atom.

Next, the concrete examples of the representative magenta coupler in the present invention will be shown but will not be limited by them.

M-1

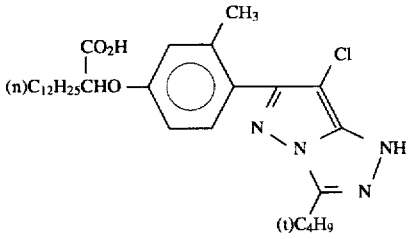

M-2

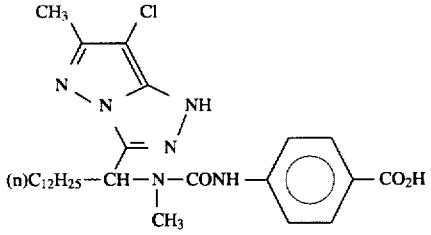

-continued
M-3
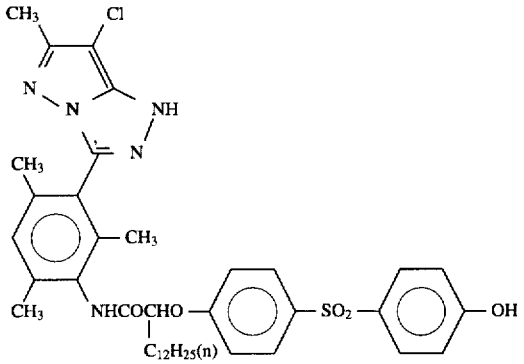
M-4
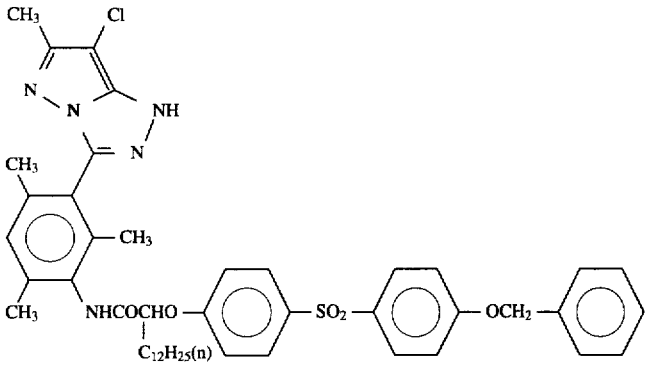
M-5
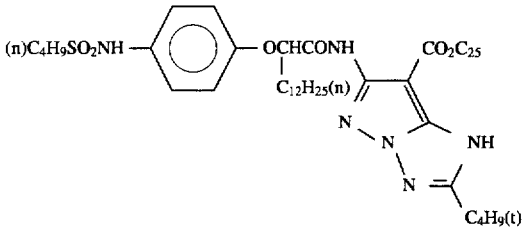
M-6
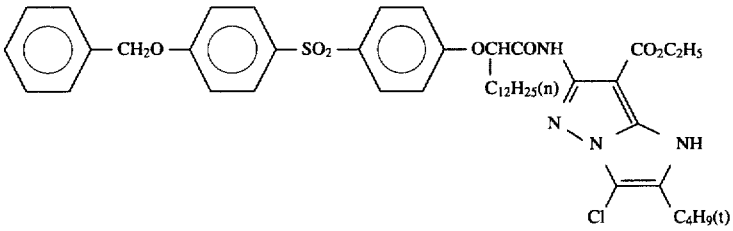
M-7
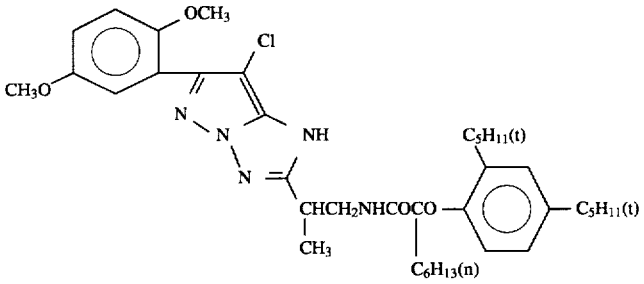

-continued
M-8
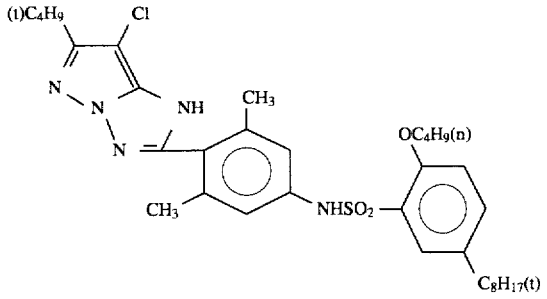

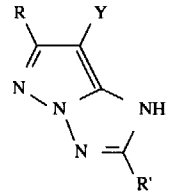
| Compound | R | R' | Y |
|---|---|---|---|
| M-9 | $CH_3-$ | 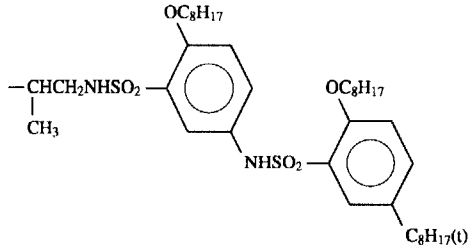 | Cl |
| M-10 | same as above | 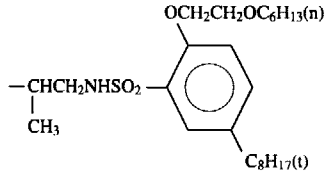 | same as above |
| M-11 | $(CH_3)_3C-$ | 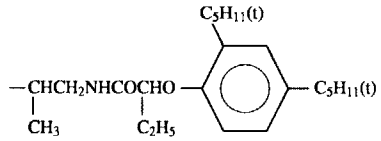 | 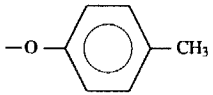 |
| M-12 | 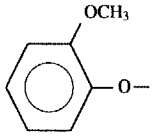 | 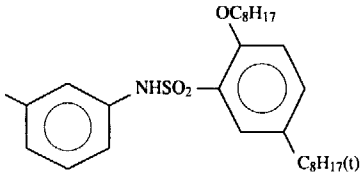 | 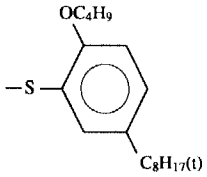 |

-continued
| | | | |
|---|---|---|---|
| M-13 | $CH_3-$ | 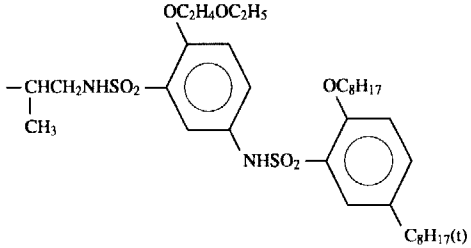 | Cl |
| M-14 | same as above | 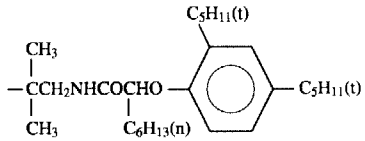 | same as above |
| M-15 | same as above | 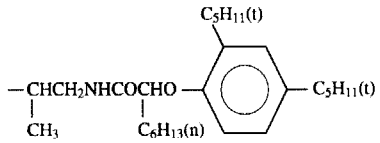 | same as above |
| M-16 | $CH_3-$ | 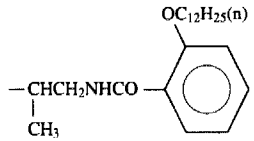 | Cl |
| M-17 | same as above | 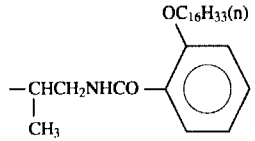 | same as above |

-continued
| | | | |
|---|---|---|---|
| M-18 | 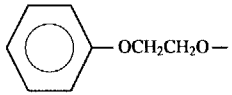 | 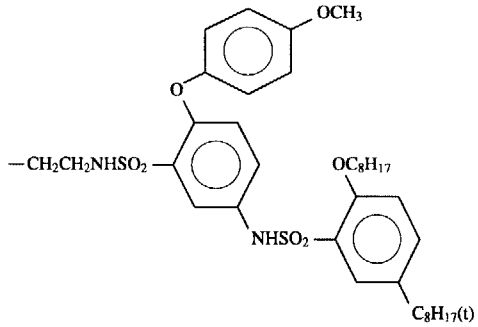 | 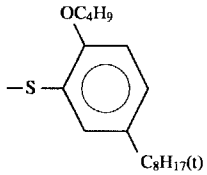 |
| M-19 | $CH_3CH_2O-$ | same as above | same as above |
| M-20 | 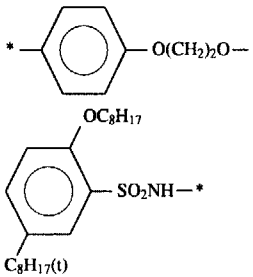 | 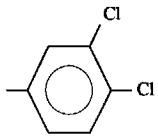 | 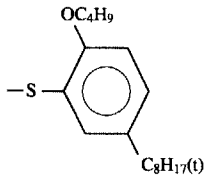 |
| M-21 | 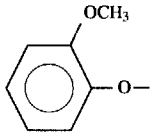 | 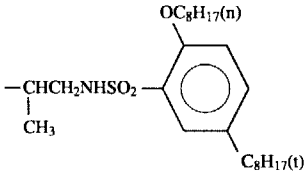 | Cl |

-continued
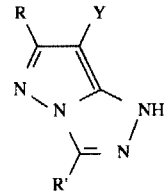
| Compound | R | R' | Y |
|---|---|---|---|
| M-22 | $CH_3-$ | 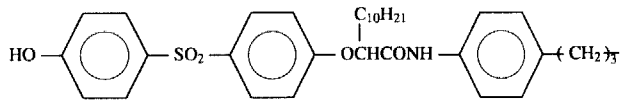 | Cl |
| M-23 | same as above | 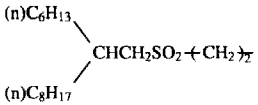 | same as above |
| M-24 | 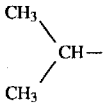 | 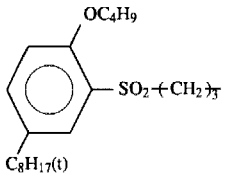 | same as above |
| M-25 | 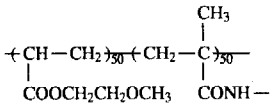 | 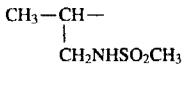 | same as above |
| M-26 | $(CH_3)_3C-$ | $+CH_2)_3SO_2C_{12}H_{25}$ | Cl |
| M-27 | $CH_3-$ | 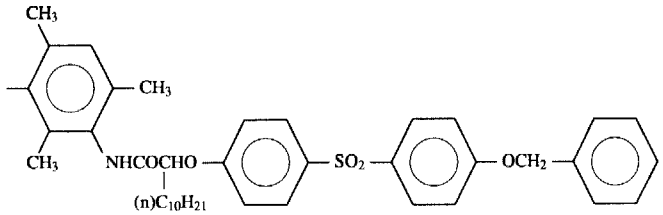 | same as above |

-continued
| | | | |
|---|---|---|---|
| M-28 | $(CH_3)_3C-$ | 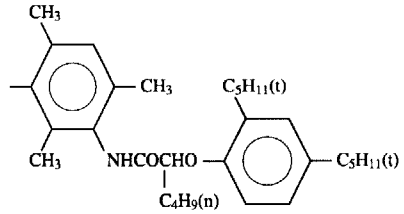 | same as above |
| M-29 | 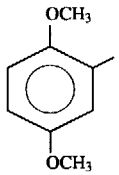 | 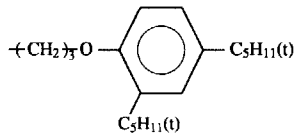 | same as above |
| M-30 | $CH_3-$ | 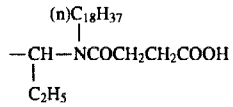 | same as above |
| M-31 | | 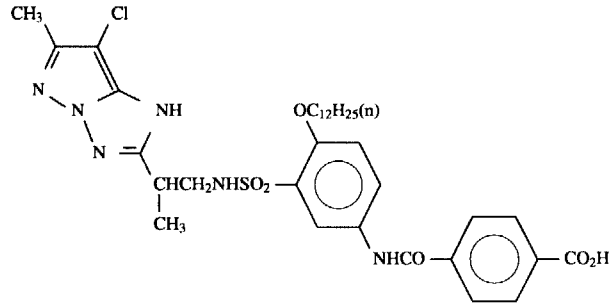 | |
| M-32 | | 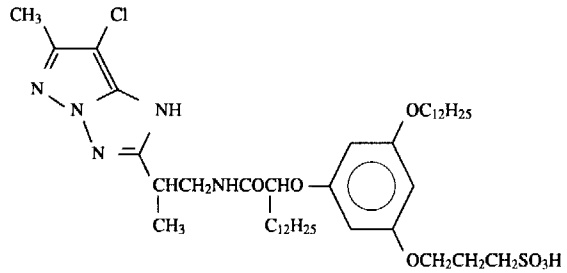 | |

-continued
M-33
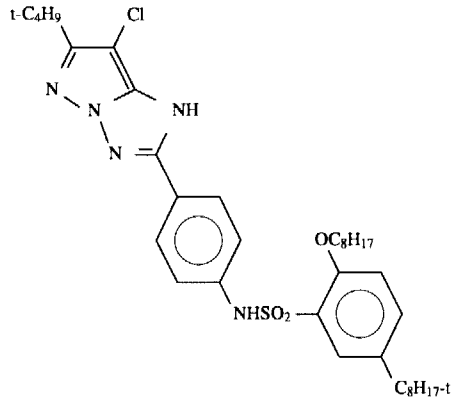
M-34
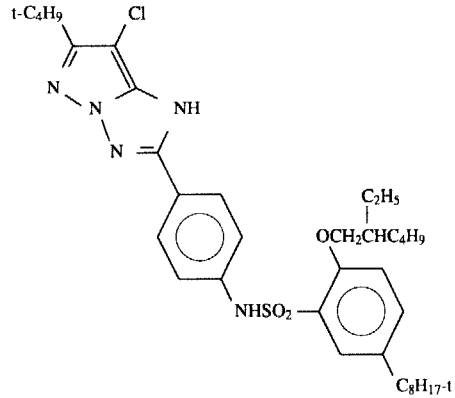

-continued
M-35
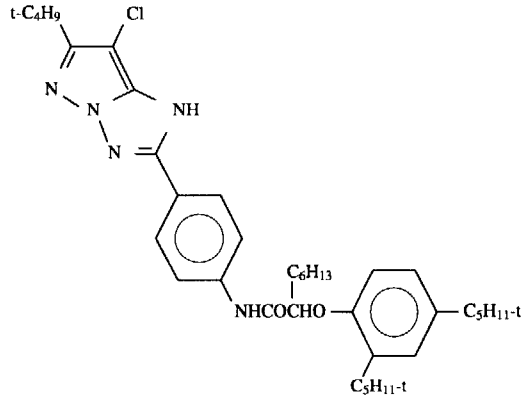
M-36
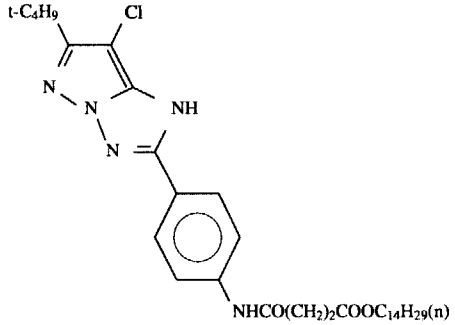
M-37
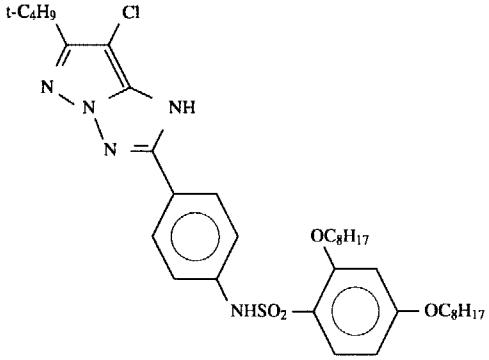

-continued
M-38
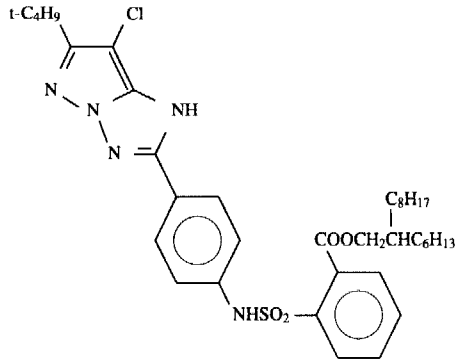
M-39
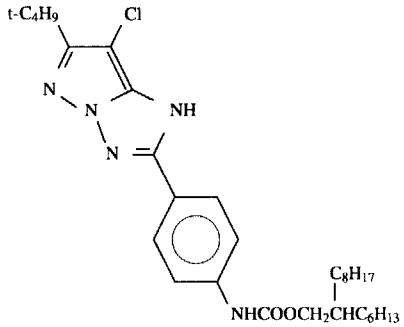
M-40
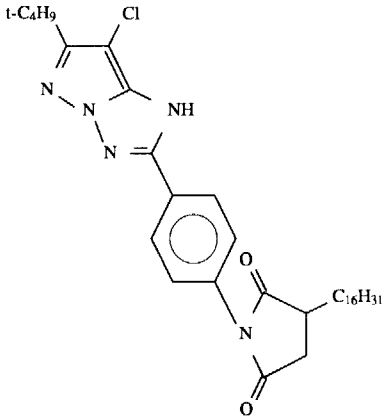

-continued
M-41
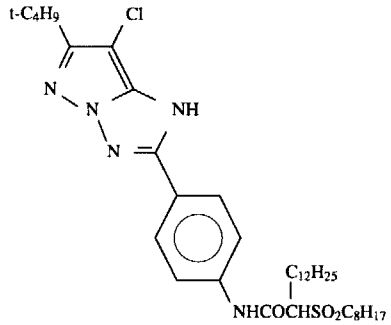
M-42
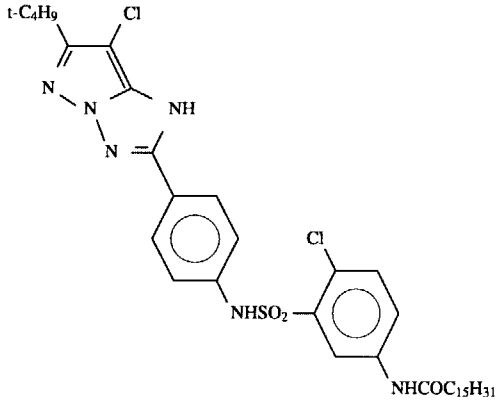
M-43
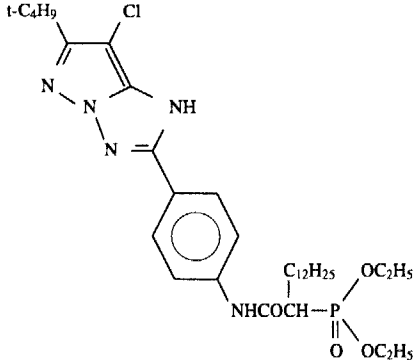

-continued
M-44
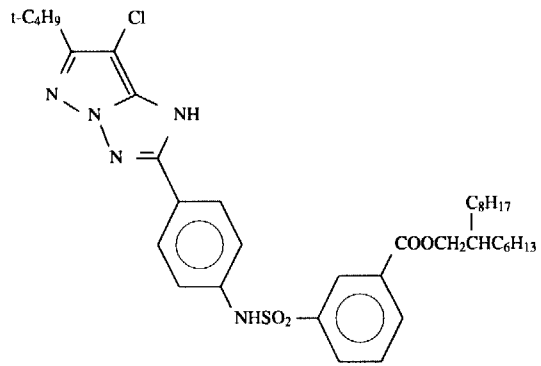
M-45
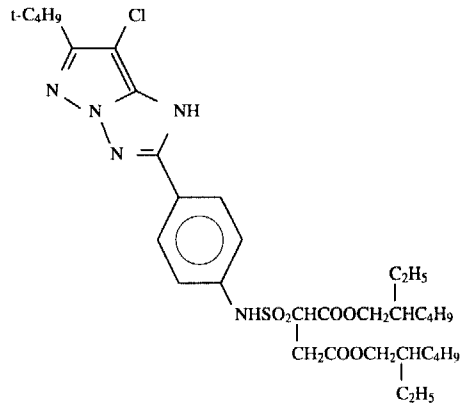

-continued
M-46
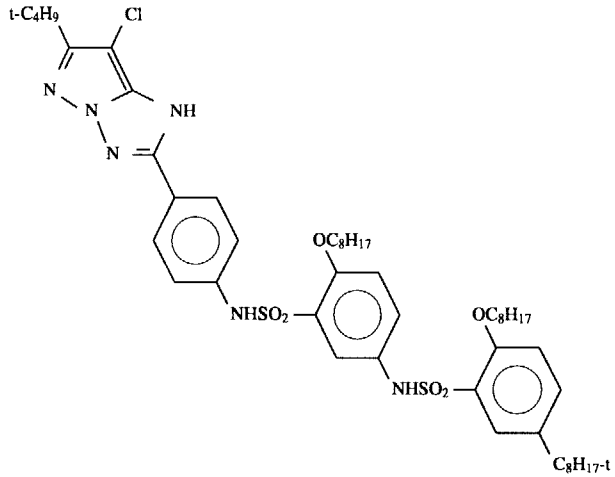
M-47
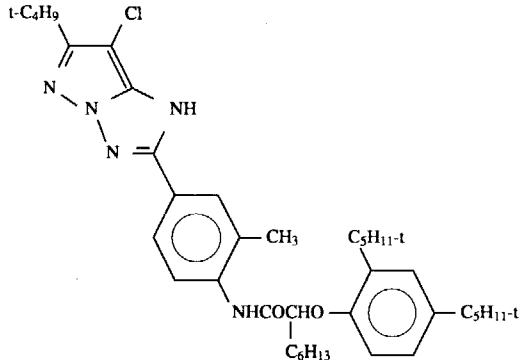

-continued
M-48
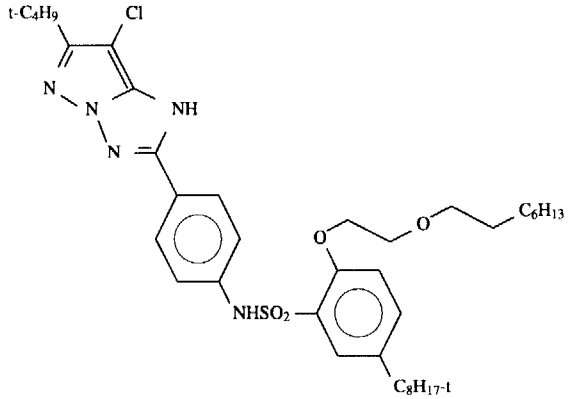
M-49
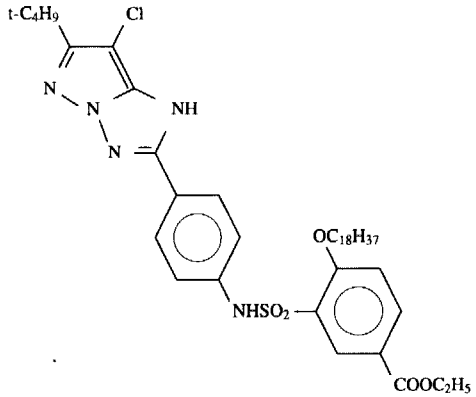

-continued
M-50
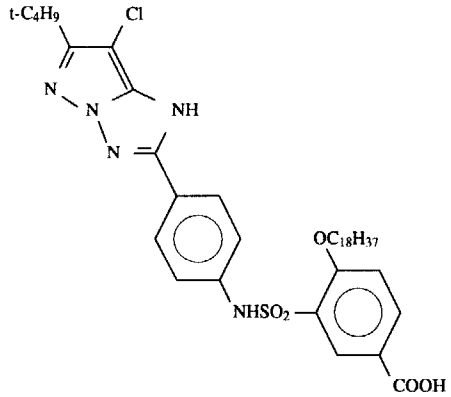
M-51
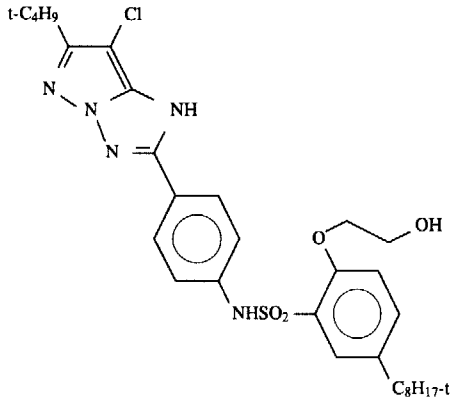

-continued
M-52
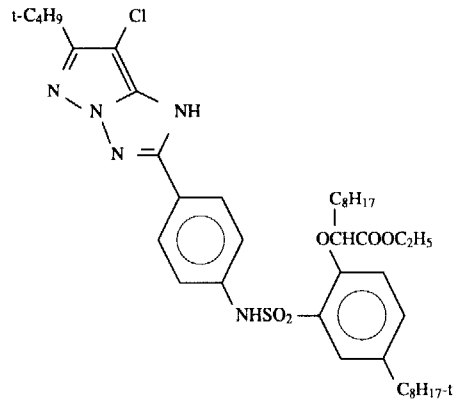
M-53
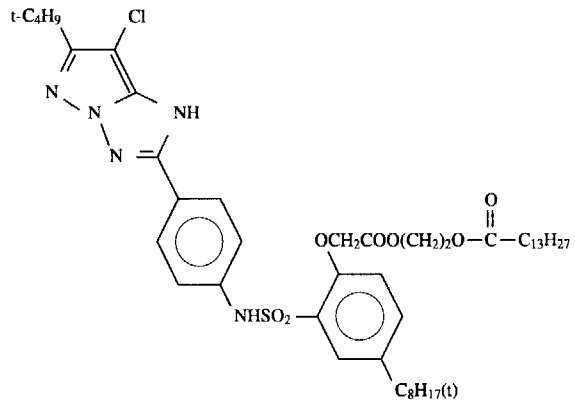

-continued
M-54
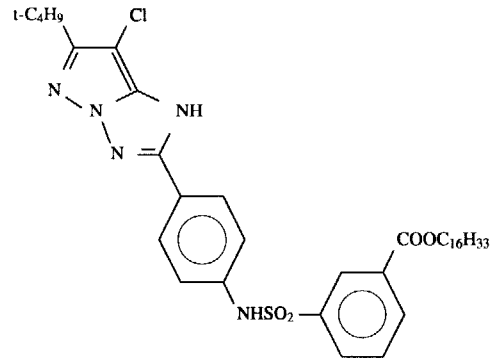
M-55
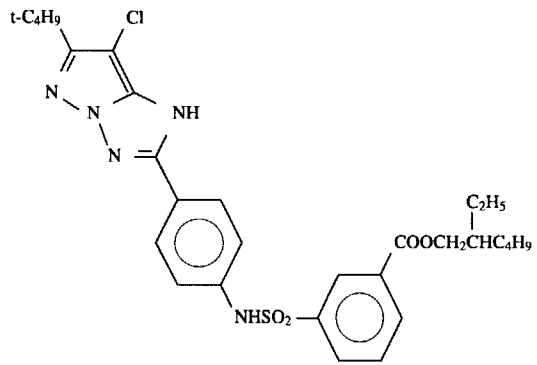
M-56
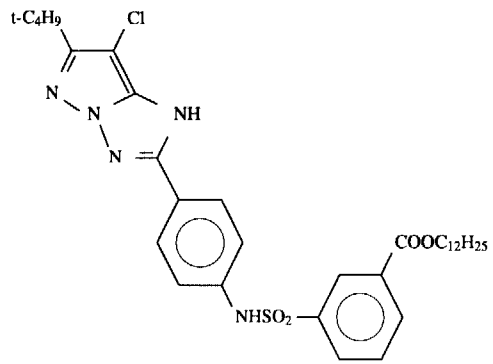

-continued
M-57
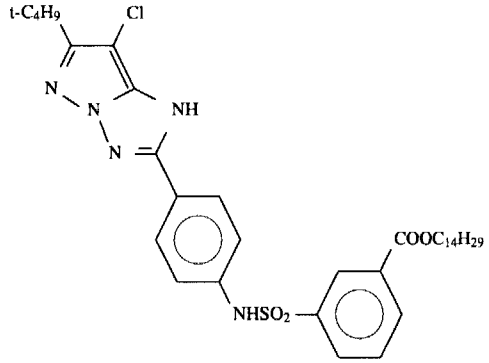
M-58
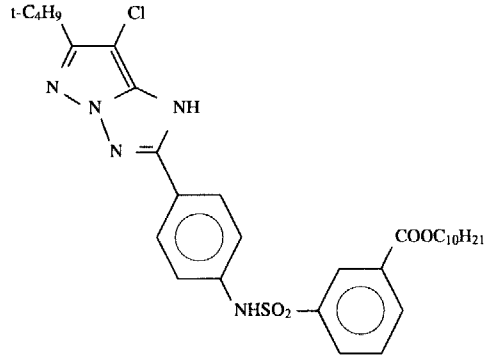
M-59
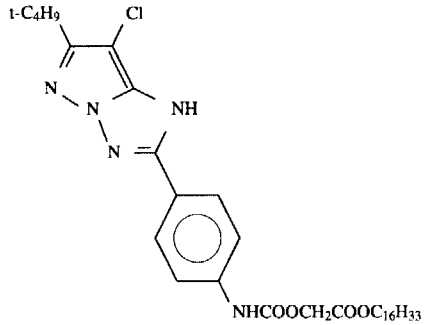

-continued
M-60
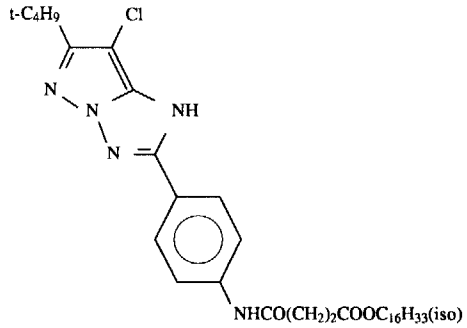
M-61
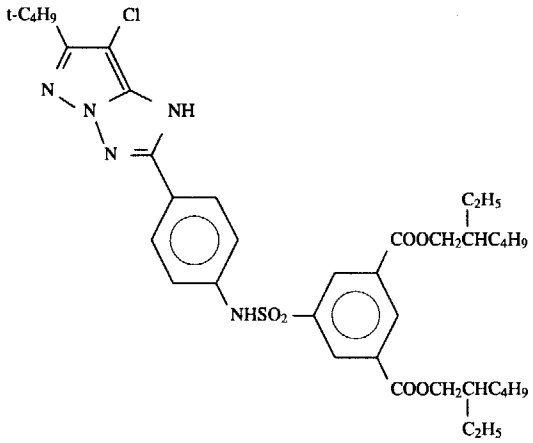

-continued
M-62
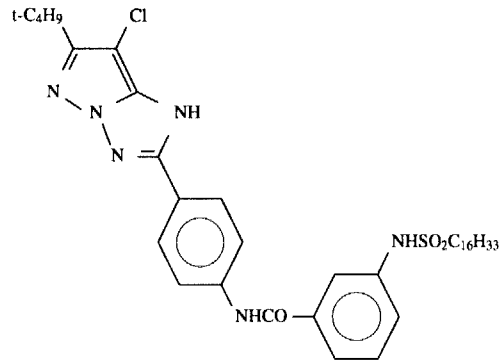
M-63
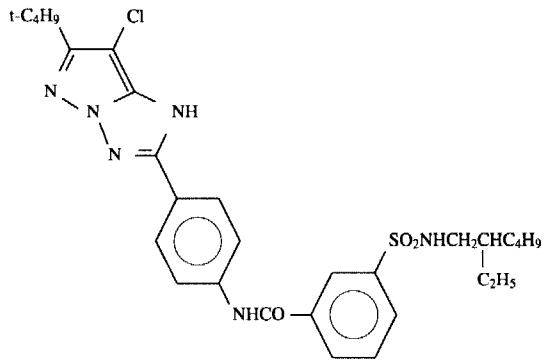
M-64
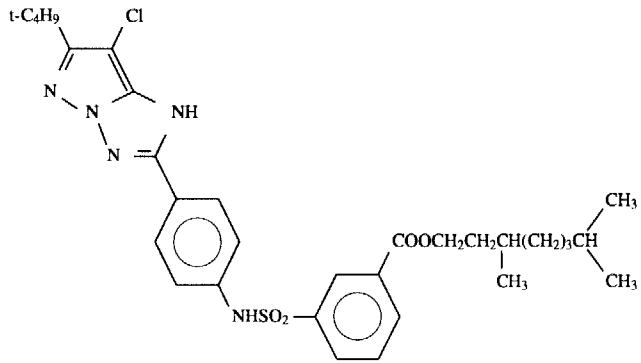

-continued
M-65
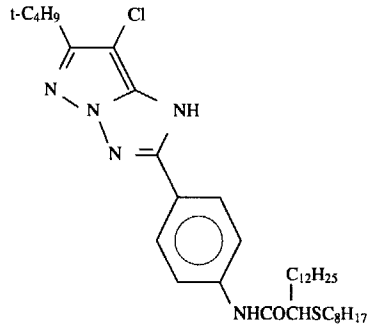
M-66
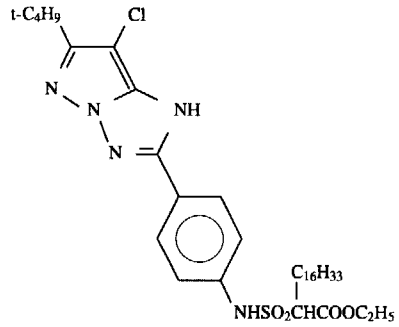
M-67
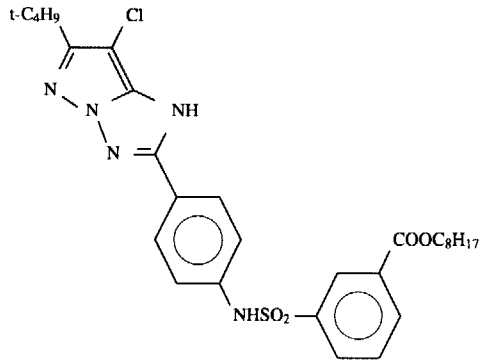

-continued
M-68
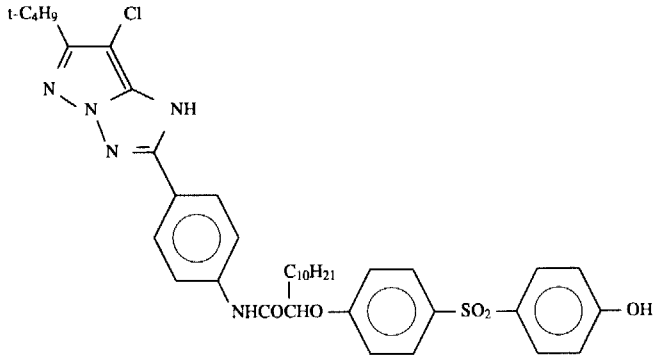
M-69
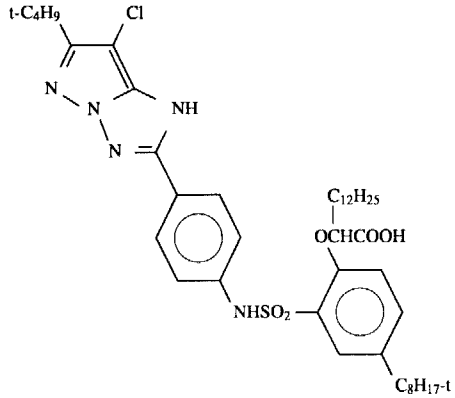

-continued
M-70
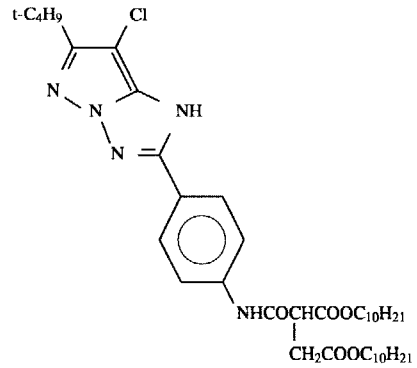
M-71
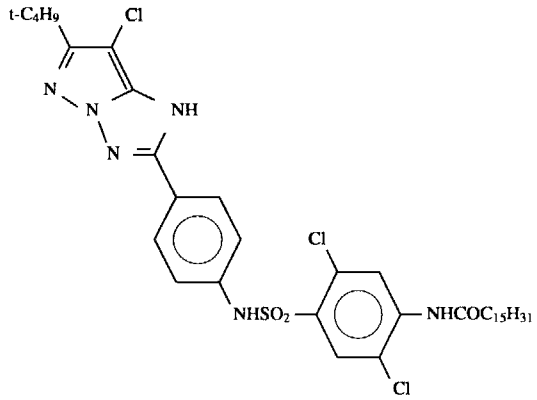

-continued
M-72
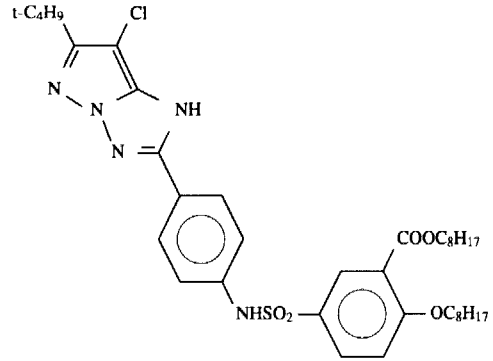
M-73
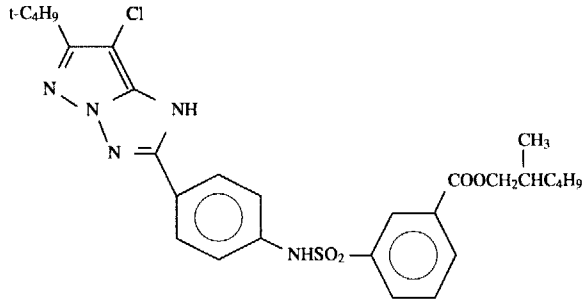
M-74
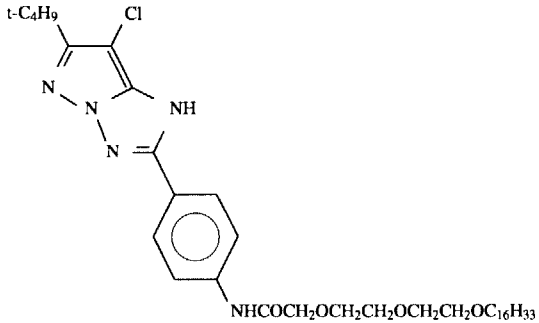

-continued
M-75
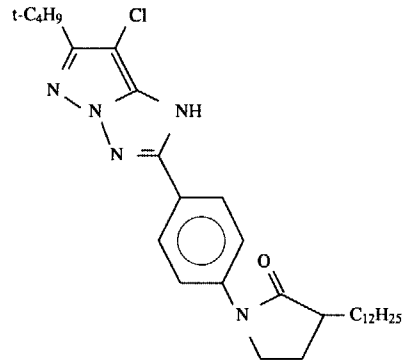
M-76
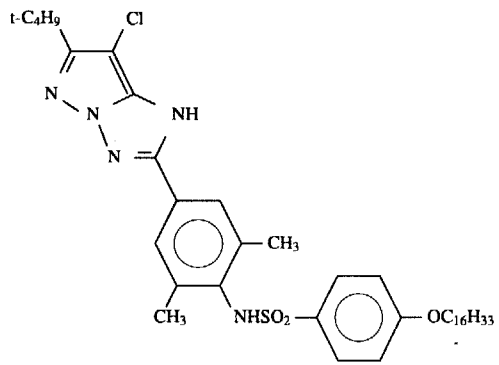
M-77
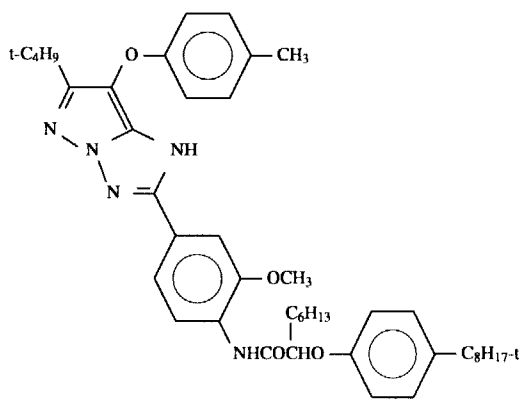

-continued
M-78
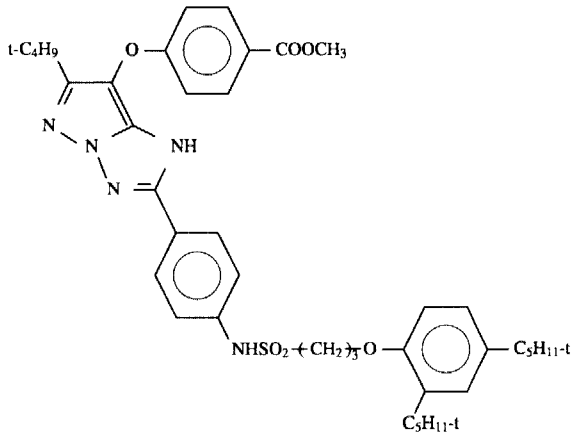
M-79
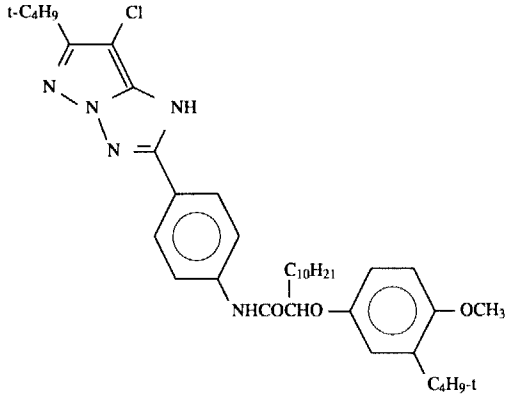

-continued
M-80
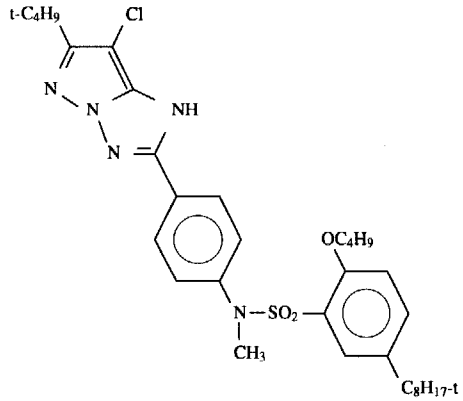
M-81
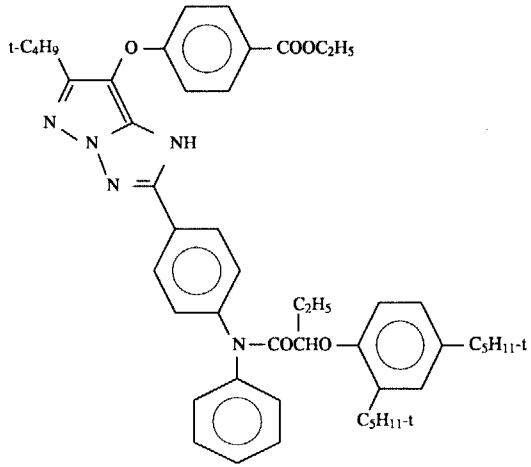

-continued
M-82
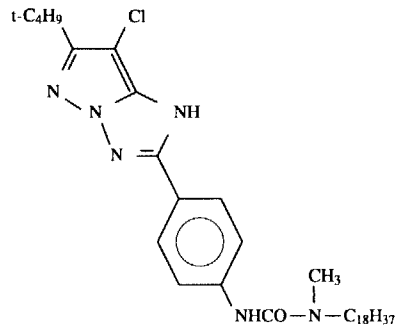
M-83
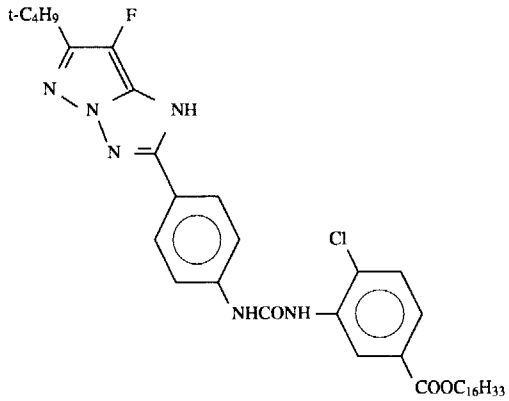
M-84
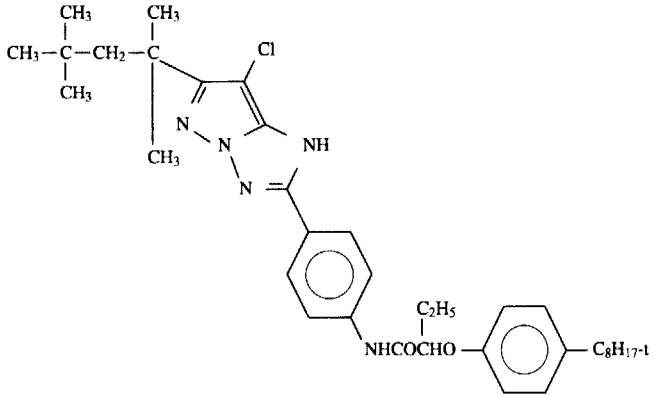

-continued
M-85
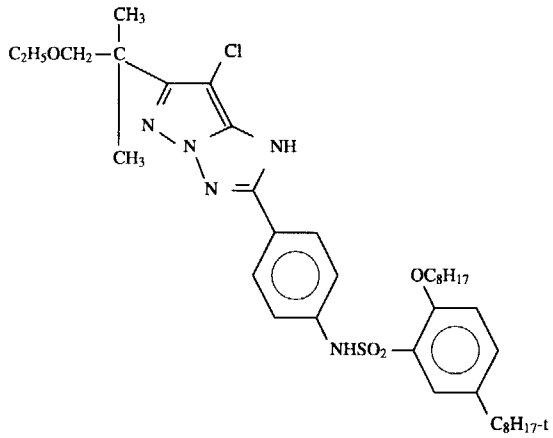
M-86
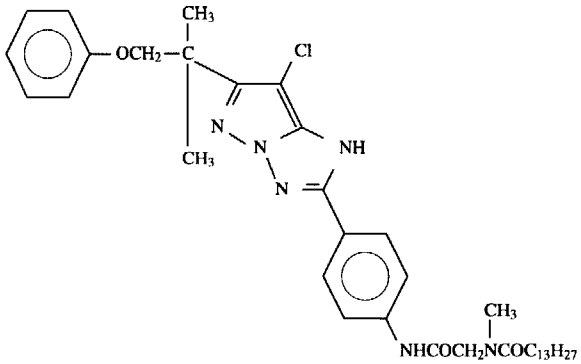

-continued
M-87
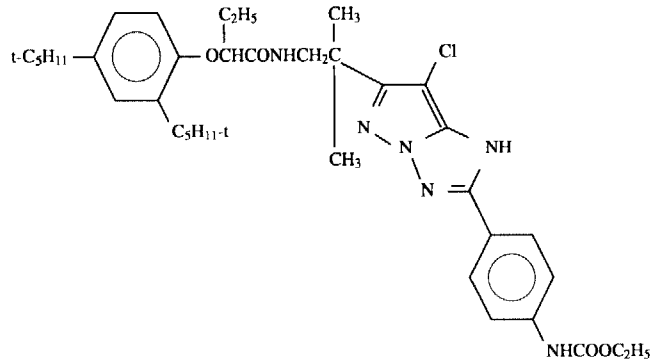
M-88
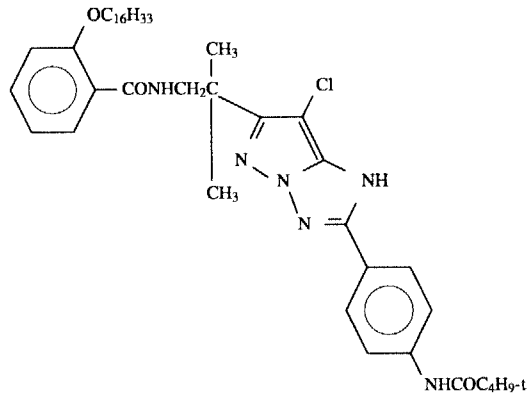

-continued
M-89
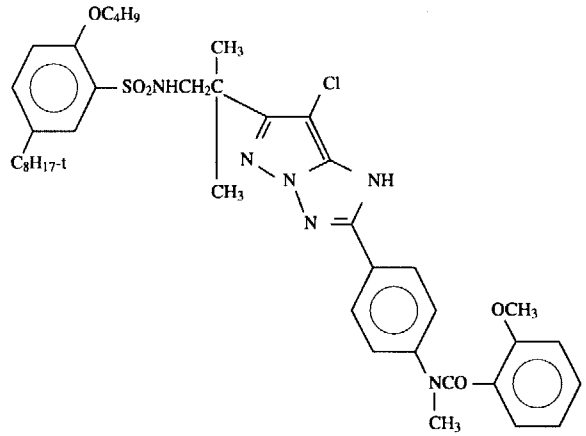
M-90
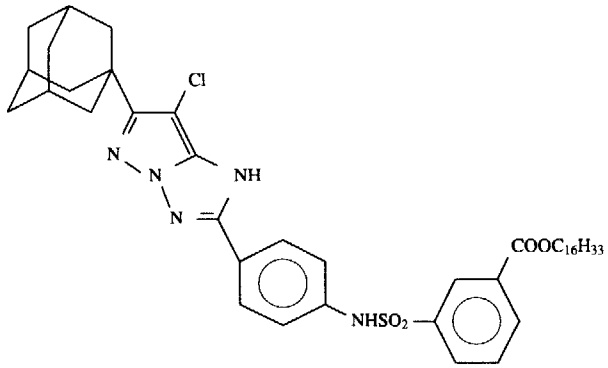

-continued
| | |
|---|---|
| M-91 | 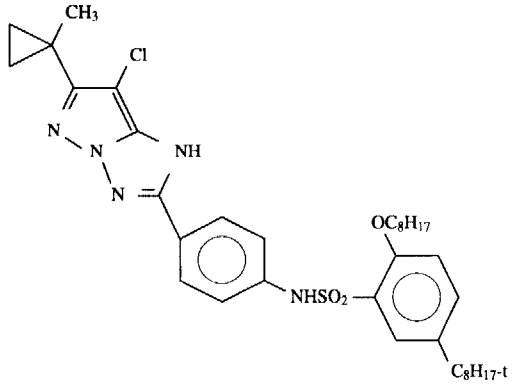 |

The concrete examples and the synthetic processes of the pyrazolotriazole series magenta coupler represented by Formula (I) used in the present invention are described in JP-A-59-1625485, JP-A-60-43659, JP-A-59-171956, JP-A-60-33552, JP-A-60-172982, JP-A-61-292143, JP-A-63-231341, JP-A-63-291058, U.S. Pat. Nos. 3,061,432 and 4,728,598, and Japanese patent application No. 4-157405.

The coupler of the present invention can usually be used in a range of $1\times10^{-3}$ mole to 1 mole, preferably $1\times10^{-2}$ mole to $8\times10^{-1}$ mole per mole of silver halide.

Further, the coupler of the present invention may be used in combination of two or more kinds and can be used in combination with a coupler having a different main structure such as the other pyrazolone series according to necessity. Next, the compound represented by Formula [II] will be described in further detail.

The details of X and Y in the compound of Formula [II] are described in JP-B-48-30493 (the term "JP-B" as used herein means an examined Japanese patent publication), U.S. Pat. No. 3,698,907, and JP-B-48-31255.

In Formula (II), X and Y each preferably have carbon atoms enough to provide non-diffusibility to the coupler, and more preferably 1 to 36 carbon atoms including carbon atoms of substituents thereof.

Of the compounds of Formula [II], preferred is the one in which X is an alkoxy group, Z is a carbonyl group and both of p and 1 are 1. A substituting position of X is preferably a 5-position to a hydroxyl group.

The compound of the present invention represented by Formula (II) is used in a proportion of 1 to 300 weight %, preferably 20 to 200 weight % based on the magenta coupler of Formula (I).

Next, the concrete examples of the compound of the present invention represented by Formula [II] will be shown but the present invention will not be limited thereto.

blue-sensitive silver halide emulsion layer, a green-sensitive silver halide emulsion layer, and a red-sensitive silver halide emulsion layer are coated in this order on the support but the order may be different from this. Further, at least one of the above light-sensitive emulsion layers can be replaced with an infrared-sensitive silver halide emulsion layer. The silver halide emulsions having the sensitivities in the respective wavelength regions and the color couplers which form the dyes having the relationship of a complementary color with the rays to which the emulsions are sensitive can be allowed to be contained in these light-sensitive emulsions to carry out a color reproduction by a subtractive color process. Provided that there may be taken the constitution in which the light-sensitive emulsion layers have no such the relationship as mentioned above with the hues of the dyes developed with the color couplers.

The magenta coupler of the present invention can be incorporated into the light-sensitive material by various conventional dispersing methods. Preferred is an oil-in-water dispersing method in which they are dissolved in a high boiling solvent (a low boiling solvent is used in combination according to necessity) and are emulsified and dispersed in a gelatin aqueous solution to add to a silver halide emulsion.

The examples of the high boiling solvent used in the oil-in-water dispersion method are described in U.S. Pat. No. 2,322,027. The step and effect of a latex dispersing method as one of the polymer dispersing methods and the concrete examples of a latex for impregnation are described in U.S. Pat. No. 4,199,363, German Pat. No. Applications (OLS) 2,541,274 and 2,541,230, JP-B-53-41091, and European Patent unexecuted application No. 029104, and further a dispersion method by an organic solvent-soluble polymer is described in PCT International Patent unexamined application No. W088/00723.

The high boiling organic solvent which can be used in the

| Compound of Formula II | Z | X | Y | p | —(OH) |
|---|---|---|---|---|---|
| 1 | —CO— | 5-$OCH_3$ | H | 1 | |
| 2 | —CO— | 5-$OC_4H_9$(n) | H | 1 | |
| 3 | —CO— | 5-$OC_4H_9$(sec) | H | 1 | |
| 4 | —CO— | 5-$OC_4H_9$(t) | H | 1 | |
| 5 | —CO— | 5-$OC_8H_{17}$(n) | H | 1 | |
| 6 | —CO— | 5-$OC_8H_{17}$(sec) | H | 1 | |
| 7 | —CO— | 5-$OC_8H_{17}$(t) | H | 1 | |
| 8 | —CO— | 5-$OC_{12}H_{25}$(n) | H | 1 | |
| 9 | —CO— | 5-$OC_{12}H_{25}$(sec) | H | 1 | |
| 10 | —CO— | 5-$OC_{12}H_{25}$(t) | H | 1 | |
| 11 | —CO— | 5-$OC_{16}H_{33}$(n) | H | 1 | |
| 12 | —CO— | 5-$OC_{18}H_{35}$(n) | H | 1 | |
| 13 | —CO— | 4-$OC_4H_9$(n) | 4'-$OCH_3$ | 3 | 2'-, 5'- |
| 14 | —CO— | 5-$COCH_3$ | 3'-$C_8H_{17}$(n) | 3 | 2'-, 6'- |
| 15 | —CO— | 5-$C_{12}H_{25}$(n) | 4'-$COCH_3$ | 2 | 2'- |
| 16 | —CO— | 5-$COCH_3$ | 3'-$C_8H_{17}$(n) | 3 | 2'-, 6'- |
| 17 | —CO— | 4-$OC_{12}H_{25}$(n) | 4'-$OCH_2C_6H_4$-(p)$CH_3$ | 2 | 2'- |
| 18 | —CO— | 5-$C_8H_{17}$ | 4'-$COC_6H_4$-(p)$CH_3$ | 3 | 2'-, 6'- |
| 19 | —COO— | 4-$C_{12}H_{25}$(n) | 4'-$C_4H_9$(t) | 1 | |
| 20 | —COO— | H | 4'-$C_4H_9$(t) | 1 | |
| 21 | —COO— | 4-$C_{12}H_{25}$(n) | 5'-$OCH_3$ | 2 | 2'- |
| 22 | —COO— | 3-$OCH_3$ | 5'-$OC_{12}H_{25}$ | 2 | 2'- |

The light-sensitive material of the present invention may have at least one layer containing the magenta coupler of the present invention on a support. The layer containing the magenta coupler of the present invention may be a hydrophilic layer provided on the support. In general, the light-sensitive material can be of the constitution in which a above oil-in-water dispersion method includes phthalic acid esters (for example, dibutyl phthalate, dioctyl phthalate, dicyclohexyl phthalate, di-2-ethylhexyl phthalate, decyl phthalate, bis(2,4-di-tert-amylphenyl)isophthalate, and bis(1,1-di-ethylpropyl)phthalate), phosphoric acid or phosphonic acid esters (for example, diphenyl phosphate, triphenyl phosphate, tricresyl phosphate, 2-ethylhexyldiphenyl phosphate, dioctylbutyl phosphate, tricyclohexyl phosphate, tri-2-ethylhexyl phosphate, tridodecyl phosphate, and di-2-ethylhexylphenyl phosphate), benzoic acid esters (for example, 2-ethylhexyl benzoate, 2,4-dichlorobenzoate, dodecyl benzoate, and 2-ethylhexyl-p-hydroxybenzoate), amides (for example, N,N-diethyl dodecanamide and N,N-diethyl laurylamide), alcohols or phenols (for example, isostearyl alcohol and 2,4-di-tert-amylphenol), aliphatic esters (for example, dibutoxyethyl succinate, di-2-ethylhexyl succinate, 2-hexyldecyl tetradecanate, tributyl citrate, diethyl azelate, isostearyl lactate, and trioctyl citrate), an aniline derivative (for example, N,N-dibutyl-2-butoxy-5-tert-octylaniline), chlorinated paraffin (for example, paraffins having a chlorine content of 10 to 80%), trimesic acid esters (for example, tributyl trimesate), dodecylbenzene, diisopropylnaphthalene, phenols (for example, 2,4-di-tert-amylphenol, 4-dodecyloxyphenol, 4-dodecyloxycarbonylphenol, and 4-(4-dodecyloxyphenylsulfonyl)phenol), carboxylic acids (for example, 2-(2,4-di-tert-amylphenoxy)butyric acid, and 2-ethoxyoctanedecanoic acid), and alkylphosphoric acids (for example, di-2(ethylhexyl)phosphoric acid and diphenylphosphoric acid). Further, there may be used in combination as an auxiliary solvent, an organic solvent having a boiling point of 30° C. or higher and about 160° C. or lower (for example, ethyl acetate, butyl acetate, ethyl propionate, methyl ethyl ketone, cyclohexanone, 2-ethoxyethyl acetate, and dimethylformamide).

The high boiling solvents can be used in an amount of 0 to 10.0 times, preferably 0 to 4.0 times an amount of a coupler by weight ratio.

With respect to a method for adding the compound of Formula [II], it is preferably incorporated into a photographic constitutional layer in a form of an emulsified dispersion obtained by dissolving it in a high boiling organic solvent together with the coupler of Formula [I] to co-emulsify them.

The photographic constitutional layer containing the compounds of Formulas [I] and [II] is preferably a light-sensitive silver halide emulsion layer. Further, a green-sensitive layer is a preferred embodiment as this light-sensitive silver halide emulsion layer. It may be an infrared-sensitive layer, a red-sensitive layer or a blue-sensitive layer.

In addition to the diphenylimidazole series cyan couplers described in JP-A-2-33144, preferably used as a cyan coupler are the 3-hydroxypyridine series cyan couplers (of them, particularly preferred are the coupler prepared by providing the tetra-equivalent coupler (42) exemplified as the concrete example with a chlorine splitting group to convert it to a divalent coupler, and the couplers (6) and (9)) described in European Patent EP 0333185A2, and the cyclic active methylene series cyan couplers (of them, particularly preferred are the couplers 3, 8 and 34 which are exemplified as the concrete example) described in JP-A-64-32260, the pyrrolopyrazole type cyan couplers described in European Patent EP 0456226A1, the pyrroloimidazole type cyan couplers described in European Patent EP 0484909, and the pyrrolotriazole type cyan couplers described in European Patents EP 0488248 and EP 0491197A1. Of them, the pyrrolotriazole type cyan couplers are particularly preferably used.

In addition to the compounds described in the above tables, preferably used as the yellow coupler are the acylacetoamide type yellow couplers having a 3- to 5-membered cyclic structure on an acyl group, described in European Patent EP 0447969A1, the malondianilide type yellow couplers having a cyclic structure described in European Patent EP 0482552A1, and the acylacetoamide type yellow couplers having a dioxane structure described in U.S. Pat. No. 5,118,599. Of them, particularly preferably used are the acylacetoamide type yellow coupler in which the acyl group is a 1-alkylcyclopropane-1-carbonyl group, and the malondianilide type yellow coupler in which one of anilides constitutes an indoline ring. These couplers can be used singly or in combination.

In addition to the processes described in the above tables, preferred as a processing process for the color light-sensitive material of the present invention are the processing materials and processing processes described on page 26, a right lower column, line 1 up to page 34, right upper column, line 20 of JP-A-2-207250, and on page 5, left upper column,line 17 to page 18 right lower column, line 20 of JP-A-4-97355.

Those described in the following patent publications, particularly European Patent EP 0,355,660A2 are preferably used as the silver halide emulsions, other materials (the additives) and photographic constitutional layers (a layer arrangement) each applied in the present invention, and the processing methods and additives for processing, which are applied for processing this light-sensitive material:

| Photographic elements | JP-A-62-215272 | JP-A-2-33144 | EP 0,355,660A2 |
|---|---|---|---|
| Silver halide emulsion | pp. 10, right upper colmn, line 6 to pp. 12, left lower colmn, line 5, and pp. 12, right lower colmn, line 4 from bottom to pp. 13, left upper colmn, line 17. | pp. 28, right upper colmn, line 16 to pp. 29, right lower colmn, line 11, and pp. 30, lines 2 to 5. | pp. 45, line 53 to pp. 47, line 3, and pp. 47, lines 20 to 22. |
| Silver halide solvent | pp. 12, left lower colmn, lines 6 to 14, and pp. 13, left upper colmn, line 3 from bottom to pp. 18, left lower colmn, last line. | — | — |
| Chemical sensitizer | pp. 12, left lower colmn, line 3 from bottom to right lower colmn, line 5 from bottom, and pp. 18, right lower colmn, line 1 to pp. 22, right upper colmn, line 9 from bottom. | pp. 29, right lower colmn, line 12 to last line. | pp. 47, lines 4 to 9. |
| Spectral | pp. 22, right upper colmn, | pp. 30, left upper colmn, | pp. 47, lines 10 to 15. |

-continued

| Photographic elements | JP-A-62-215272 | JP-A-2-33144 | EP 0,355,660A2 |
|---|---|---|---|
| sensitizer (spectral sensitizing process) | line 8 from bottom to pp. 38, last line. | lines 1 to 13. | |
| Emulsion stabilizer | pp. 39, left upper colmn, line 1 to pp. 72, right upper colmn, last line. | pp. 30, left upper colmn, line 14 to right upper colmn, line 1. | pp. 47, lines 16 to 19. |
| Development accelerator | pp. 72, left lower colmn, line 1 to pp. 91, right upper colmn, line 3. | — | — |
| Color coupler (cyan, magenta and yellow couplers) | pp. 91, right upper colmn, line 4 to pp. 121, left upper colmn, line 6. | pp. 3, right upper colmn, line 14 to pp. 18, left upper colmn, last line, and pp. 30, right upper colmn, line 6 to pp. 35 right lower colmn, line 11. | pp. 4, lines 15 to 27, pp. 5, line 30 to pp. 28, last line, pp. 45, lines 29 to 31, and pp. 47, line 23 to pp. 63, line. 50 |
| Color forming accelerator | pp. 121, left lower colmn, line 7 to pp. 125, right upper colmn, line 1. | — | — |
| UV absorber | pp. 125, right upper colmn, line 2 to pp. 127, left lower colmn, last line. | pp. 37, right lower colmn, line 14 to pp. 38, left upper colmn, line 11. | pp. 65, lines 22 to 31. |
| Anti-fading agent (an image stabilizer) | pp. 127, right lower colmn, line 1 to pp. 137, left lower colmn, line 8. | pp. 36, right upper colmn, line 12 to pp. 37, left upper colmn, line 19. | pp. 4, line 30 to pp. 5, line 23, pp. 29, line 1 to pp. 45, line 25, pp. 45, lines 33 to 40, and pp. 65, lines 2 to 21. |
| High boiling and/or low boiling organic solvent | pp. 137, left lower colmn, line 9 to pp. 144, right upper, last line. | pp. 35, right lower colmn, line 14 to pp. 36, left upper, line 4. | pp. 64, lines 1 to 51. |
| Process for dispersing photographic additives | pp. 144, left lower colmn, line 1 to pp. 146, right upper colmn, line 7. | pp. 27, right lower colmn, line 10 to pp. 28, left upper, last line, and pp. 35, right lower colmn, line 12 to pp. 36, right upper colmn, line 7. | pp. 63, line 51 to pp. 64, line 56. |
| Hardener | pp. 146, right upper colmn, line 8 to pp. 155, left lower colmn, line 4. | — | — |
| Precursor of a developing agent | pp. 155, left lower colmn, line 5 to right lower colmn, line 2. | — | — |
| Development inhibitor-releasing compound | pp. 155, right lower colmn, lines 3 to 9. | — | — |
| Support | pp. 155, right lower colmn, line 19 to pp. 156, left upper colmn, line 14. | pp. 38, right upper colmn, line 18 to pp. 39, left upper colmn, line 3. | pp. 66, line 29 to pp. 67 line 13. |
| Light-sensitive layer structure | pp. 156, left upper colmn, line 15 to right lower colmn, line 14. | pp. 28, right upper colmn, lines 1 to 15. | pp. 45, lines 41 to 52 |
| Dye | pp. 156, right lower colmn, line 15 to pp. 184, right lower colmn, last line. | pp. 38, left upper colmn, line 12 to right upper colmn, line 7. | pp. 66, lines 18 to 22. |
| Anti-color mixing agent | pp. 185, left upper colmn, line 1 to pp. 188, right lower colmn, line 3. | pp. 36, right upper colmn, lines 8 to 11. | pp. 64, line 57 to pp. 65 line 1. |
| Gradation controller | pp. 188, right lower colmn, lines 4 to 8. | — | — |
| Anti-stain agent | pp. 188, right lower colmn, line 9 to pp. 193, right lower colmn, line 10. | pp. 37, left upper colmn, last line to right lower colmn, line 13. | pp. 65, line 32 to pp. 66, line 17. |
| Surface active agent | pp. 201, left lower colmn, line 1 to pp. 210, right upper colmn, last line | pp. 18, right upper colmn, line 1 to pp. 24, right lower colmn, last line, and pp. 27, left lower colmn, line 10 from bottom to right lower colmn, line 9. | — |
| Fluorinated compound (anti-static agent, coating aid, lubricant and anti-adhesion | pp. 210, left lower colmn, line 1 to pp. 222, left lower colmn, line 5. | pp. 25, left upper colmn, line 1 to pp. 27, right upper colmn, line 9. | — |

-continued

| Photographic elements | JP-A-62-215272 | JP-A-2-33144 | EP 0,355,660A2 |
|---|---|---|---|
| agent) | | | |
| Binder (hydrophilic colloid) | pp. 222, left lower colmn, line 6 to pp. 225, left upper colmn, last line | pp. 38, right upper colmn, lines 8 to 18. | pp. 66, lines 23 to 28. |
| Thickener | pp. 225, right upper colmn, line 1 to pp. 227, right upper colmn, line 2. | — | — |
| Anti-static agent | pp. 227, right upper colmn, line 3 to pp. 230, left upper colmn, line 1. | — | — |
| Polymer latex | pp. 230, left upper colmn, line 2 to pp. 239, last line | — | — |
| Matting agent | pp. 240, left upper colmn, line 1 to right upper colmn, last line. | — | — |
| Photographic processing method (processing steps and additives) | pp. 3, right upper colmn, line 7 to pp. 10, right upper colmn, line 5. | pp. 39, left upper colmn, line 4 to pp. 42, left upper colmn, last line. | pp. 67, line 14 to pp. 69, line 28. |

Remarks:
1. The content amended according to the Amendment of March 16, 1987 is included in the cited items of JP-A-62-215272.
2. Of the above color couplers, also preferably used as a yellow coupler are the so-called short wave type yellow couplers described in JP-A-63-231451, JP-A-63-123047, JP-A-63-241547, JP-A-1-173499, JP-A-1-213648, and JP-A-1-250944.

There can be used as silver halide used in the present invention, silver chloride, silver bromide, silver chlorobromide, silver iodochloride, silver iodochlorobromide, and silver iodobromide. Particularly for a purpose of a rapid processing, preferably used is silver chlorobromide containing substantially no silver iodide and having a silver chloride content of 90 mole % or more, more preferably 95 mole % or more, and particularly preferably 98 mole % or more, or pure silver chloride.

For the purpose of improving a sharpness of an image, the dyes (among them, an oxonol series dye) capable of being decolored by processing, described at pages 27 to 76 of European Patent EP 0,337,490A2 are preferably added to a hydrophilic colloid layer of the light-sensitive material according to the present invention so that an optical reflection density of the light-sensitive material in 680 nm becomes 0.70 or more, and there is preferably incorporated into an anti-water resin layer of a support, titanium oxide which is subjected to a surface treatment with di- to tetrahydric alcohols (for example, trimethylolethane) in a proportion of 12 by weight or more (more preferably 14% by weight or more).

Also, in the light-sensitive material according to the present invention, the color image preservability-improving compounds described in European Patent EP0,277,589A2 are preferably used together with couplers. In particular, they are used preferably in combination with a pyrazoloazole series magenta coupler.

Preferably used simultaneously or singly for preventing side effects of, for example, the generation of stain due to a color-developed dye formed by a reaction of a color developing agent or the oxidation product thereof remained in a layer during storage after processing with a coupler are the compound (F) which is chemically combined with an aromatic amine series developing agent remained after a color development processing to form a chemically inactive and substantially colorless compound, and/or the compound (G) which is chemically combined with the oxidation product of the aromatic amine series developing agent remained after the color development processing to form a chemically inactive and substantially colorless compound.

Further, the anti-mold agents described in JP-A-63-271247 are preferably added to the light-sensitive material according to the present invention for a purpose of preventing various molds and bacteria which grow in a hydrophilic colloid layer to deteriorate an image.

There may be used as a support for the light-sensitive material according to the present invention for display, a white color polyester series support or a support in which a layer containing a white pigment is provided on a support side having a silver halide emulsion layer. Further, an anti-halation layer is preferably provided on a support side coated thereon with a silver halide emulsion layer or the backside thereof in order to improve a sharpness. In particular, a transmission density of a support is settled preferably in a range of 0.35 to 0.8 so that a display can be admired with either a reflected light or a transmitted light.

The light-sensitive material according to the present invention may be exposed with either a visible ray or an infrared ray. An exposing manner may be either a low illuminance exposure or a high illuminance exposure for a short time. Particularly in the latter case, preferred is a laser scanning exposing method in which an exposing time per a picture element (pixel) is shorter than $10^{-4}$ second.

In exposure, the band stop filter described in U.S. Pat. No. 4,880,726 is preferably used, whereby a light mixture is removed to notably improve a color reproduction.

EXAMPLES

The present invention will be explained below in further details with reference to the examples but the present invention will not be limited thereto.

Example 1

Samples 101 to 121 were prepared in the following layer structure. The numerals represent the coated amounts ($g/m^2$). The coated amounts of the silver halide emulsions are expressed in terms of the amounts converted to silver.
Support: polyethylene-laminated paper

[polyethylene coated on the 1st layer side contains a white pigment ($TiO_2$) and a blue dye (ultramarine)].

| First layer (a green-sensitive emulsion layer): | |
|---|---|
| Silver chlorobromide emulsion (cube, 1:3 mixture (silver mole ratio) of a large size emulsion having an average grain size of 0.55 μm and a small size emulsion having an average grain size of 0.39 μm, wherein the fluctuation coefficients in the grain size distributions were 0.10 and 0.08, respectively, and either size emulsions contained silver bromide of 0.8 mol % localized at a part of a grain surface) | 0.13 |
| Gelatin | 2.50 |
| Magenta coupler (Table 14) | 0.30 |
| Dye image stabilizer-1 | 0.20 |
| Dye image stabilizer-2 | 0.05 |
| Dye image stabilizer-3 | 0.30 |
| Solvent-1 | 0.90 |
| Compound described in Table 14 | 0.30 |
| Second layer (a protective layer): | |
| Gelatin | 2.00 |
| Solvent-1 | 0.30 |
| Compound described in Table 14 | 0.30 |

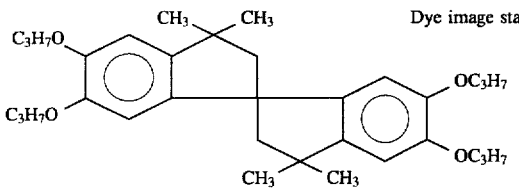

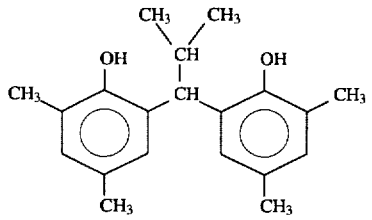

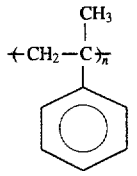

average polymerization degree
n = about 20

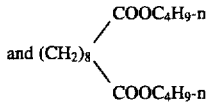

Twenty one kinds of the samples thus prepared were exposed with a sensitometer (FWH manufactured by Fuji Photo Film Co., Ltd.) through an optical wedge using a green light, and then they were processed according to the following processing steps.

A paper processing machine was used and the following processing steps and the solutions having the following processing solution compositions were applied to carry out a continuous processing for a standard sample, whereby a development processing solution which was put in a running equilibrium status was prepared.

| Processing step | Temperature | Time | Replenishing amount* | Tank capacity |
|---|---|---|---|---|
| Color developing | 35° C. | 45 seconds | 161 ml | 17 l |
| Bleach/fixing | 30 to 35° C. | 45 seconds | 215 ml | 17 l |
| Rinsing | 30° C. | 90 seconds | 350 ml | 10 l |
| Drying | 70 to 80° C. | 60 seconds | | |

*Replenishing amount: per $m^2$ of the light-sensitive material.

The compositions of the respective processing solutions are as follows:

| | Tank solution | Replenishing solution |
|---|---|---|
| Color developing solution | | |
| Water | 800 ml | 800 ml |
| Ethylenediamine-N,N,N',N'-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidethyl)-3-methyl-4-aminoaniline sulfate | 5.0 g | 7.0 g |
| N,N-bis(carboxymethyl)hydrazine | 4.0 g | 5.0 g |
| Fluorescent whitening agent (Whitex 4B manufactured by Sumitomo Chem. Ind. Co., Ltd.)) | 1.0 g | 2.0 g |
| Water was added to | 1000 ml | 1000 ml |
| pH (25° C.) | 10.05 | 10.45 |
| Bleach/fixing solution | | |
| (Common to the tank solution and the replenishing solution) | | |
| Water | 400 ml | |
| Ammonium thiosulfate (700 g/liter) | 100 ml | |
| Sodium sulfite | 17 g | |
| Iron (III) ammonium ethylenediamine-tetracetate | 55 g | |
| Disodium ethylenediaminetetraacetate | 5 g | |
| Ammonium bromide | 40 g | |
| Water was added to | 1000 ml | |
| pH (25° C.) | 6.0 | |

Rinsing solution (Common to the tank solution and the replenishing solution) Deionized water (contents of calcium and magnesium: each 3 ppm or less)

The above processing solutions were used to carry out the processing, and then the respective samples thus obtained were subjected to a Y-stain test at a non-color developed part in the following manner. The results obtained are shown in Table 1.

Y-stain test

The Y-stain was expressed by:

Y-stain=DB'-DB wherein the yellow densities at the non-color developed part before and after irradiating a sun light for 2 months using an under-glass outdoor exposing table were set at DB and DB', respectively. The results obtained are shown in Table 14.

TABLE 1

| | Second layer | First layer | | |
|---|---|---|---|---|
| Sample No. | Compound of Formula (II) | Example coupler | Compound of Formula (II) | Y-stain |
| 101 (Comp.) | — | M-35 | — | 0.11 |

TABLE 1-continued

| Sample No. | Second layer: Compound of Formula (II) | First layer: Example coupler | First layer: Compound of Formula (II) | Y-stain |
|---|---|---|---|---|
| 102 (Comp.) | 1 | M-35 | — | 0.10 |
| 103 (Inv.) | — | M-35 | 1 | 0.02 |
| 104 (Comp.) | — | M-38 | — | 0.13 |
| 105 (Comp.) | 5 | M-38 | — | 0.11 |
| 106 (Inv.) | — | M-38 | 5 | 0.03 |
| 107 (Comp.) | — | M-40 | — | 0.14 |
| 108 (Comp.) | 8 | M-40 | — | 0.12 |
| 109 (Inv.) | — | M-40 | 8 | 0.04 |
| 110 (Comp.) | — | M-45 | — | 0.15 |
| 111 (Comp.) | 12 | M-45 | — | 0.12 |
| 112 (Inv.) | — | M-45 | 12 | 0.04 |
| 113 (Comp.) | 1 | M-60 | — | 0.10 |
| 114 (Inv.) | — | M-60 | 1 | 0.02 |
| 115 (Comp.) | — | M-36 | — | 0.10 |
| 116 (Comp.) | 18 | M-36 | — | 0.08 |
| 117 (Inv.) | — | M-36 | 18 | 0.02 |
| 118 (Inv.) | — | M-36 | 5 | 0.02 |
| 119 (Inv.) | — | M-36 | 10 | 0.03 |
| 120 (Inv.) | — | M-36 | 11 | 0.02 |
| 121 (Inv.) | — | M-36 | 13 | 0.03 |

It can be found from the results summarized in Table 1 that the incorporation of the compound of the present invention into the second layer provides only a little effect and that the addition thereof to the first layer in which the coupler of the present invention is present markedly reveals the effect, which shows that the effect according to the present invention is not merely due to a UV ray cut effect.

EXAMPLE 2

After a surface of a paper support laminated on the both sides thereof with polyethylene was subjected to a corona discharge treatment, a subbing layer containing sodium dodecylbenzenesulfonate was provided. Further, various photographic constitutional layers were coated thereon to prepare the multi-layer color photographic paper (201) having the layer structure shown below. The coating solutions were prepared in the following manners.

Preparation of the first layer-coating solution

The yellow coupler (ExY-1) 153.0 g, the dye image stabilizer (Cpd-1) 15.0 g, the dye image stabilizer (Cpd2) 7.5 g, and the dye image stabilizer (Cpd-3) 16.0 g were dissolved in the solvent (Solv-1) 25 g, the solvent (Solv-2) 25 g and ethyl acetate 180.0 ml, and this solution was emulsified and dispersed in a 10% gelatin aqueous solution 1000 g containing a 10% sodium dodecylbenzenesulfonate aqueous solution 60 ml and citric acid 10 g to thereby prepare the emulsified dispersion A.

Meanwhile, there was prepared the silver chlorobromide emulsion A (cube, a 3:7 mixture (silver mole ratio) of a large size emulsion A having an average grain size of 0.88 μm and a small size emulsion A having an average grain size of 0.70 μm, wherein the fluctuation coefficients in the grain size distributions were 0.08 and 0.10, respectively, and either size emulsions contained silver bromide of 0.3 mol % localized at a part of a surface of a grain comprising basically silver chloride). The blue-sensitive sensitizing dyes A and B shown below were added to this emulsion in the amounts of each $2.0\times10^{-4}$ mole per mole of silver to the large size emulsion A and each $2.5\times10^{-4}$ mole per mole of silver to the small size emulsion A. Then, this emulsion was subjected to an optimum chemical sensitization by adding a sulfur sensitizer and a gold sensitizer. The emulsified dispersion A described above and this silver chlorobromide emulsion A were mixed and dissolved, whereby the first layer-coating solution was prepared so that it was of a composition shown below. An emulsion coated amount is represented in terms of a coated amount converted to a silver amount.

The coating solutions for the second layer to the seventh layer were prepared as well in the same manner as that in the first layer-coating solution. Sodium 1-oxy-3,5-dichloro-s-triazine was used as a gelatin hardener for the respective layers.

Further, Cpd-14 and Cpd-15 were added to the respective layers so that the whole amounts thereof became 25.0 mg/m$^2$ and 50.0 mg/m$^2$, respectively.

The following spectral sensitizing dyes were used for the silver chlorobromide emulsions contained in the respective light-sensitive emulsion layers:

Blue-sensitive emulsion layer:

Sensitizing dye A

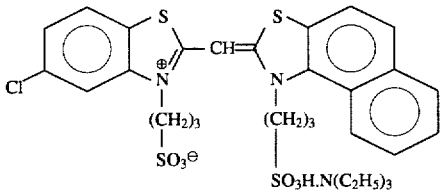

and

Sensitizing dye B

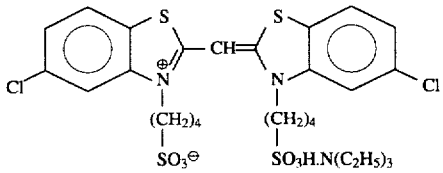

(each $2.0\times10^{-4}$ mole per mole of silver halide to the large size emulsion and each $2.5\times10^{-4}$ mole per mole of silver halide to the small size emulsion).

Green-sensitive emulsion layer:

Sensitizing dye C

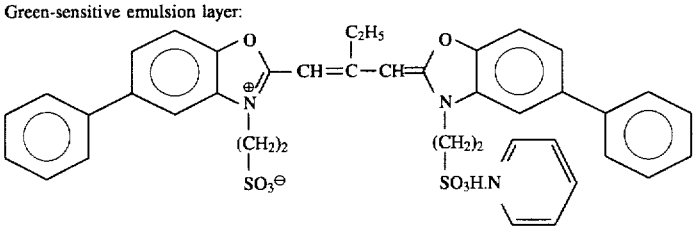

($4.0\times10^{-4}$ mole per mole of silver halide to the large size emulsion and $5.6\times10^{-4}$ mole per mole of silver halide to the small size emulsion) and Sensitizing dye D

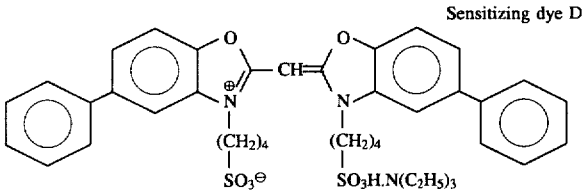

($7.0\times10^{-5}$ mole per mole of silver halide to the large size emulsion and $1.0\times10^{-4}$ mole per mole of silver halide to the small size emulsion).

Red-sensitive emulsion layer:

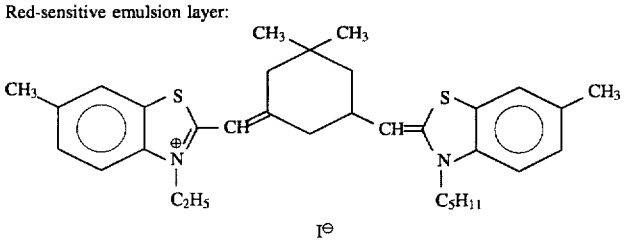

($0.9\times10^{-4}$ mole per mole of silver halide to the large size emulsion and $1.1\times10^{-4}$ mole per mole of silver halide to the small size emulsion) Further, the following compound was added in an amount of $2.6\times10^{-3}$ mole per mole of silver halide:

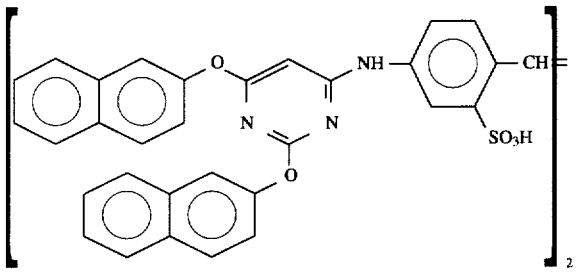

Further, 1-(5-methylureidophenyl)-5-mercaptotetrazole was added to the blue-sensitive emulsion layer, the green-sensitive emulsion layer and the red-sensitive emulsion layer in the amounts of $8.5\times10^{-5}$ mole, $7.7\times10^{-4}$ mole and $2.5\times10^{-4}$ mole per mole of silver halide, respectively.

Further, 4-hydroxy-6-methyl-l,3,3a,7-tetrazaindene was added to the blue-sensitive emulsion layer and the green-sensitive emulsion layer in the amounts of $1\times10^{-4}$ mole and $2\times10^{-4}$ mole per mole of silver halide, respectively.

Further, the following dyes (a coated amount was shown in a parenthesis) were added to the emulsion layers for preventing irradiation.

Sensitizing dye E

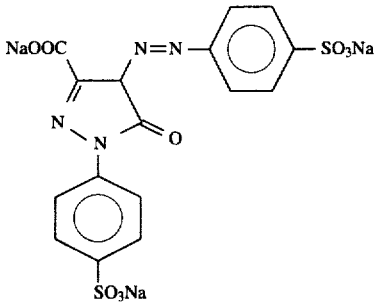

(10 mg/m²)

-continued

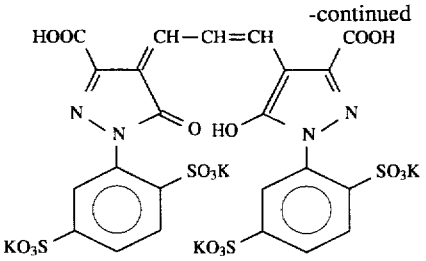

(10 mg/m²)

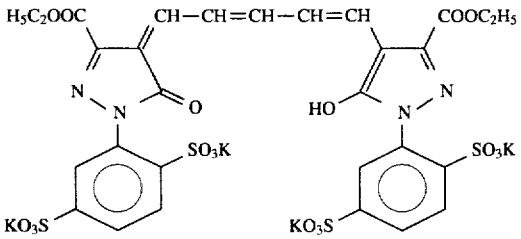

(40 mg/m²)

and

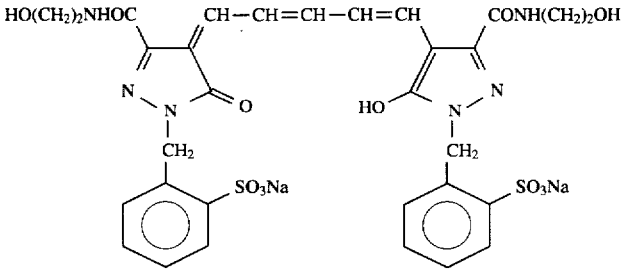

(20 mg/m²)

Further, the compounds of Formula (II) were added to the third layer as shown in Table 15 to prepare Samples 202 to 204 and 207 to 211. Meanwhile, in order to clarify the effect of the present invention (not mere UV ray cut), the compound of Formula (II) which was to be added to the third layer was added to the fifth layer in Sample 205 and Sample 212.

Further, the compounds (UV-3) and (UV-22) described in JP-A-61-250644 were added to the third layer to prepare Comparative Samples 213 and 214.

Layer constitution

The compositions of the respective layers are shown below. The numerals represent the coated amounts (g/m²). The coated amounts of the silver halide emulsions are expressed in terms of the amounts converted to silver.

Support

Polyethylene-laminated paper

[polyethylene coated on the 1st layer side contains a white pigment (titanium oxide) and a blue dye (ultramarine)].

| First layer (a blue-sensitive emulsion layer): | |
|---|---|
| Above silver chlorobromide emulsion A | 0.27 |
| Gelatin | 1.36 |
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |

-continued

| Second layer (an anti-color mixing layer): | |
|---|---|
| Gelatin | 1.10 |
| Anti-color mixing agent (Cpd-4) | 0.14 |
| Solvent (Solv-2) | 0.30 |
| Solvent (Solv-1) | 0.04 |
| Solvent (Solv-7) | 0.04 |
| UV absorber (UV-3) | 0.15 |
| Third layer (a green-sensitive emulsion layer): | |
| Silver chlorobromide emulsion (cube, 1:3 mixture (Ag mole ratio) of the large size emulsion B having an average grain size of 0.55 μm and the small size emulsion B having an average grain size of 0.39 μm, wherein the fluctuation coefficients in the grain size distributions were 0.10 and 0.08, respectively, and either size emulsions contained silver bromide of 0.8 mol % localized at a part of a surface of the grain comprising basically silver chloride) | 0.13 |
| Gelatin | 1.30 |
| Magenta coupler (Table 15) | 0.14 |
| Dye image stabilizer (Cpd-2) | 0.01 |
| Dye image stabilizer (Cpd-5) | 0.01 |
| Dye image stabilizer (Cpd-6) | 0.01 |
| Dye image stabilizer (Cpd-7) | 0.01 |
| Dye image stabilizer (Cpd-8) | 0.03 |
| Dye image stabilizer (Cpd-12) | 0.17 |
| Solvent (Solv-4) | 0.16 |
| Solvent (Solv-5) | 0.32 |
| Fourth layer (an anti-color mixing layer): | |
| Gelatin | 0.78 |
| Anti-color mixing agent (Cpd-4) | 0.10 |

| | |
|---|---|
| Solvent (Solv-2) | 0.13 |
| Solvent (Solv-1) | 0.03 |
| Solvent (Solv-7) | 0.03 |
| UV absorber (UV-3) | 0.11 |
| Fifth layer (a red-sensitive emulsion layer): | |
| Silver chlorobromide emulsion (cube, 1:4 mixture (Ag mole ratio) of the large size emulsion C having an average grain size of 0.50 μm and the small size emulsion C having an average grain size of 0.41 μm, wherein the fluctuation coefficients in the grain size distributions were 0.09 and 0.11, respectively, and either size emulsions contained silver bromide of 0.8 mol % localized at a part of a surface of the grain comprising basically silver chloride) | 0.20 |
| Gelatin | 0.85 |
| Cyan coupler (ExC) | 0.33 |
| UV absorber (UV-2) | 0.18 |
| Dye image stabilizer (Cpd-1) | 0.33 |
| Dye image stabilizer (Cpd-6) | 0.01 |

| | |
|---|---|
| Dye image stabilizer (Cpd-8) | 0.01 |
| Dye image stabilizer (Cpd-9) | 0.01 |
| Dye image stabilizer (Cpd-10) | 0.01 |
| Dye image stabilizer (Cpd-11) | 0.01 |
| Solvent (Solv-1) | 0.01 |
| Solvent (Solv-6) | 0.22 |
| Sixth layer (a UV absorbing layer): | |
| Gelatin | 0.59 |
| UV absorber (UV-1) | 0.37 |
| Dye image stabilizer (Cpd-5) | 0.02 |
| Dye image stabilizer (Cpd-12) | 0.10 |
| Solvent (Solv-3) | 0.05 |
| Seventh layer (a protective layer): | |
| Gelatin | 1.13 |
| Acryl-modified copolymer of polyvinyl alcohol (a modification degree: 17%) | 0.05 |
| Liquid paraffin | 0.02 |
| Surface active agent (Cpd-13) | 0.01 |

(ExY) Yellow coupler
1:1 Mixture (mole ratio) of:

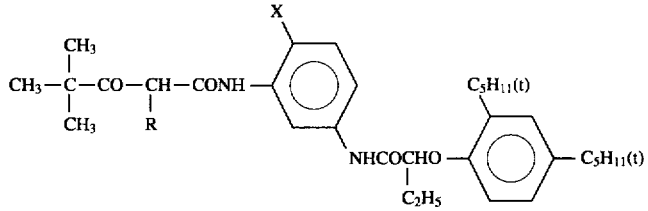

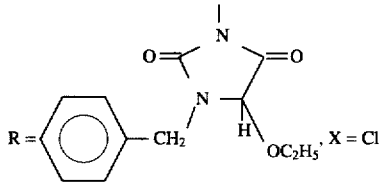

and

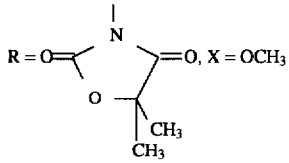

(ExC) Cyan coupler
25:75 mixture (mole ratio) of

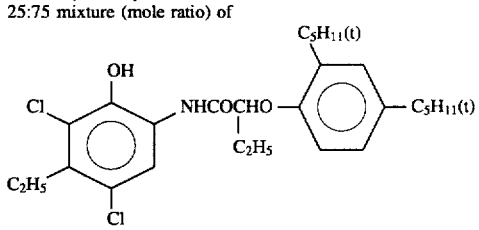

and

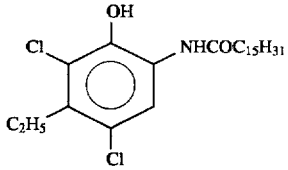

-continued
(Cpd-1) Dye image stabilizer
$$\left(CH_2-\underset{\substack{|\\ CONHC_4H_9(t)}}{CH}\right)_n$$
average molecular weight: 60,000
(Cpd-2) Dye image stabilizer
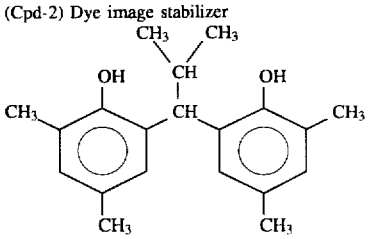
(Cpd-3) Dye image stabilizer
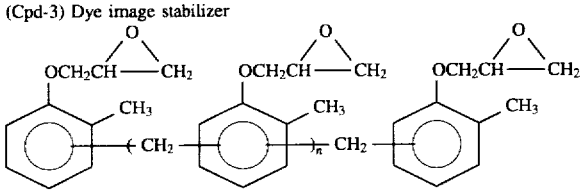
n = 7 to 8 (average value)
(Cpd-4) Anti-coloring mixing agent
1:1 mixture (weight ratio) of
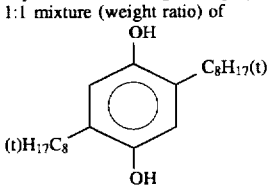
and
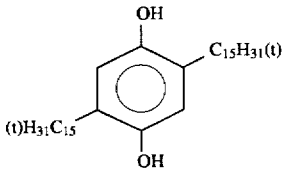
(Cpd-5) Dye image stabilizer
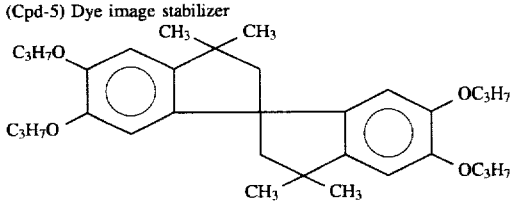
(Cpd-6) Dye image stabilizer
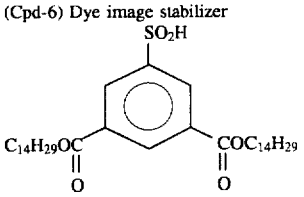
(Cpd-7) Dye image stabilizer
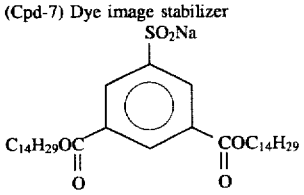

-continued
(Cpd-8) Dye image stabilizer
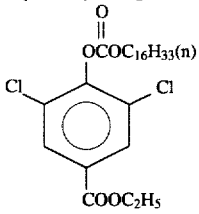
(Cpd-9) Dye image stabilzer
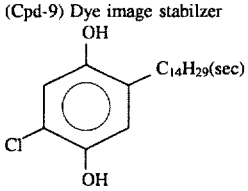
(Cpd-10) Dye image stabilizer
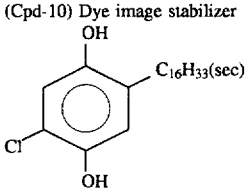
(Cpd-11) Dye image stabilizer
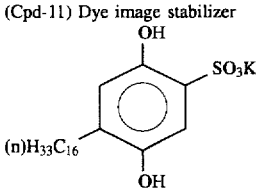
(Cpd-12) Dye image stabilizer
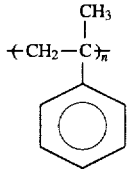
n = about 20 (average value)
(Cpd-13) Surface activen agent
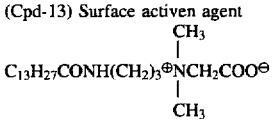
(Cpd-14) Preservative
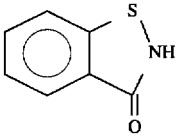
(Cpd-15) Preservative
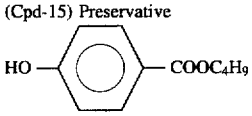

(UV-1) UV absorber
1:2:1:2:3 mixture (weight ratio) of (1), (2), (3), (4) and (5)
(1)
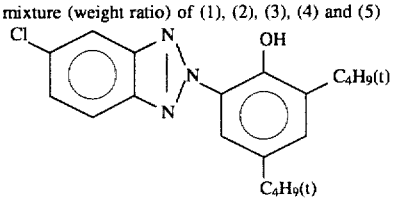
(2)
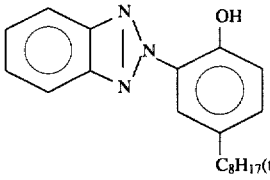
(3)
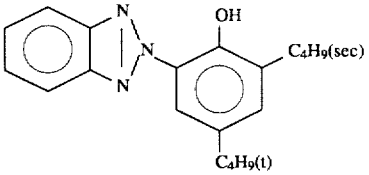
(4)
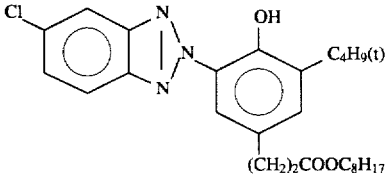
(5)
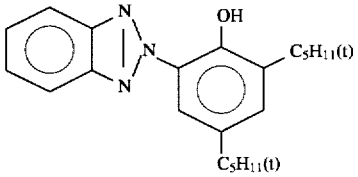
(UV-2) UV absorber
1:1:2:2 mixture (weight ratio) of (1), (2), (3) and (4)
(1)
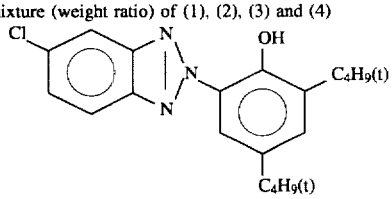
(2)
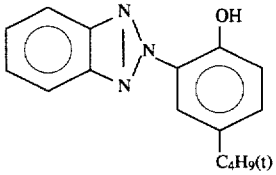
(3)
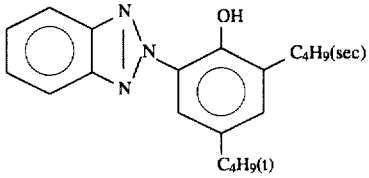
-continued
(4)
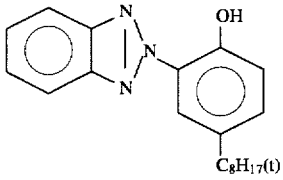
(UV-3) UV absorber
2:3:1 mixture (weight ratio) of (1), (2) and (3)
(1)
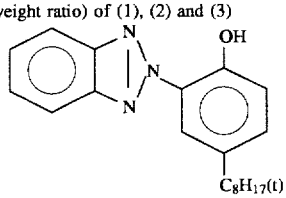
(2)
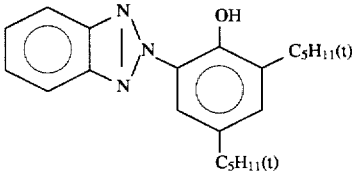
(3)
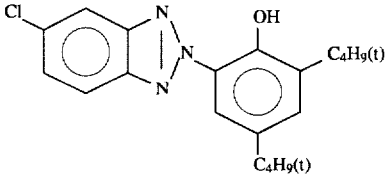
(Solv-1) Solvent
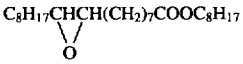
(Solv-2) Solvent
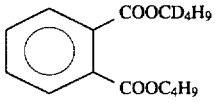
(Solv-3) Solvent
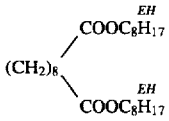
(Solv-4) Solvent
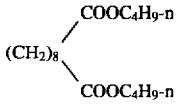
(Solv-5) Solvent
$O{=}P{+}OC_6H_{13}\text{-}n)_3$
(Solv-6) Solvent
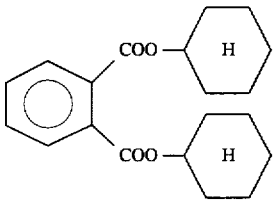

(Solv-7) Solvent

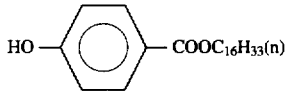

The samples obtained as described above were subjected to the following exposure and processing.

A gradational exposure was given via a gradation wedge having a three color separation filter for a sensitometry with a sensitometer (FWH type, a color temperature of a light source: 3200° K., manufactured by Fuji Photo Film Co., Ltd.), wherein exposing was carried out so that an exposure became 250 CMS at an exposing time of 1 second.

The samples which finished exposing were subjected to a color development processing at the following processing steps with a paper processing machine. After the respective samples obtained were irradiated for 20 days with a xenon tester (100,000 lux), a fading rate (%) in a magenta dye was evaluated at the initial densities of 1.5 and 0.5. A Y-stain was evaluated as well. The results obtained are shown in Table 2.

TABLE 2

| Sample No. | Magenta coupler Formula (I) | Compound of Formula (II) | Magenta dye fading rate (%) Initial density 0.5 | 1.5 | Y-stain |
|---|---|---|---|---|---|
| 201 (Comp.) | M-15 | — | 35 | 21 | 0.18 |
| 202 (Inv.) | M-15 | 1 | 18 | 19 | 0.06 |
| 203 (Inv.) | M-15 | 5 | 20 | 20 | 0.06 |
| 204 (Inv.) | M-15 | 8 | 19 | 18 | 0.06 |
| 205 (Comp.) | M-15 | 1 (to 5th layer) | 31 | 17 | 0.17 |
| 206 (Comp.) | M-36 | — | 51 | 14 | 0.21 |
| 207 (Inv.) | M-36 | 1 | 12 | 13 | 0.05 |
| 208 (Inv.) | M-36 | 5 | 12 | 12 | 0.04 |
| 209 (Inv.) | M-36 | 8 | 11 | 12 | 0.04 |
| 210 (Inv.) | M-36 | 12 | 11 | 11 | 0.05 |
| 211 (Inv.) | M-36 | 18 | 11 | 11 | 0.05 |
| 212 (Comp.) | M-36 | 12 (to 5th layer) | 48 | 12 | 0.06 |
| 213 (Comp.) | M-36 | UV-3* | 31 | 14 | 0.11 |
| 214 (Comp.) | M-36 | UV-22* | 29 | 15 | 0.12 |

Note: A coated amount of the coupler represented by Formula [I] was 0.14 g/m$^2$ and a coated amount of the coupler represented by Formula [II] was 0.11 g/m$^2$.

*: UV-3 and UV-22 are the compounds described in JP-A-61-250644. A coated amount of these compounds was 0.11 g/m$^2$.

It can be found from the results summarized in Table 2 that according to the present invention, a light fastness is excellent and a Y-stain is generated very slightly at a low density part through a high density part. Further, it is apparent as well that the effect thereof is not revealed without using the compound represented by Formula [II] for the same layer as that containing the magenta coupler of the present invention.

Further, it has been found that an anti-fading effect for a magenta series color particularly at a low density part is inferior with the benzotriazole series compound described in JP-A-61-250644.

| Processing step | Temperature | Time | Replenishing amount | Tank capacity |
|---|---|---|---|---|
| Color developing | 35° C. | 45 seconds | 161 ml | 17 l |
| Bleach/fixing | 35° C. | 45 seconds | 215 ml | 17 l |

| Processing step | Temperature | Time | Replenishing amount | Tank capacity |
|---|---|---|---|---|
| Stanbilizing (1) | 35° C. | 20 seconds | — | 10 l |
| Stabilizing (2) | 35° C. | 20 seconds | — | 10 l |
| Stabilizing (3) | 35° C. | 20 seconds | — | 10 l |
| Stabilizing (4) | 35° C. | 20 seconds | 248 ml | |
| Drying | 80° C. | 60 seconds | | |

*Replenishing amount is per m$^2$ of the light-sensitive material.

*The stabilizing step is of a four tanks countercurrent system from (4) to (1).

The compositions of the respective processing solutions are as follows:

| Color developing solution | Tank solution | Replenishing solution |
|---|---|---|
| Water | 800 ml | 800 ml |
| Poly(lithium styrenesulfonate) solution (30%) | 0.25 ml | 0.25 ml |
| 1-Hydroxyethylidene-1,1-diphosphonic acid (60%) | 0.8 ml | 0.8 ml |
| Lithium sulfate (anhydrous) | 2.7 g | 2.7 g |
| Triethanolamine | 8.0 g | 8.0 g |
| Sodium chloride | 1.8 g | — |
| Potassium bromide | 0.03 g | 0.025 g |
| Diethylhydroxylamine | 4.6 g | 7.2 g |
| Glycine | 5.2 g | 8.1 g |
| Threonine | 4.1 g | 6.4 g |
| Potassium carbonate | 27 g | 27 g |
| Potassium sulfite | 0.1 g | 0.2 g |
| N-ethyl-N-(b-methanesulfonamidethyl)-3-methyl-4-aminoaniline 3/2 sulfate monohydrate | 4.5 g | 7.3 g |
| Fluorescent whitening agent (4,4'-diaminostilbene series) | 2.0 g | 3.0 g |
| Water was added to | 1000 ml | 1000 ml |
| pH (adjusted with potassium hydroxide and sulfuric acid) | 10.12 | 10.70 |

| Bleach/fixing solution | |
|---|---|
| (Common to the tank solution and the replenishing solution) | |
| Water | 400 ml |
| Ammonium thiosulfate (700 g/liter) | 100 ml |
| Sodium sulfite | 17 g |
| Iron (III) ammonium ethylenediamine-tetraacetate | 55 g |
| Disodium ethylenediaminetetracetate | 5 g |
| Glacial acetic acid | 9 g |
| Water was added to | 1000 ml |
| pH (25° C.) (adjusted with acetic acid and aqueous ammonia) | 5.40 |
| **Stabilizing solution** | |
| (Common to the tank solution and the replenishing solution) | |
| 1,2-Benzoisothiazline-3-one | 0.02 g |
| Polyvinyl pyrrolidone | 0.05 g |
| Water was added to | 1000 ml |
| pH | 7.0 |

According to the present invention, there can be obtained a color photo which has an excellent light fastness and in which a Y-stain is generated very slightly at a low density part through a high density part.

When the coupler of Formula (If) among the couplers of Formula (I) is used, the above effects are particularly notable.

While the invention has been described in detail and with reference to specific embodiments thereof, it will be apparent to one skilled in the art that various changes and modifications can be made therein without departing from the spirits and scope thereof.

What is claimed is:

1. A silver halide color photographic light-sensitive material comprising a support and provided thereon at least one photosensitive silver halide emulsion layer containing a coupler represented by the following Formula (Id) and a compound represented by the following Formula (II);

Formula (Id)

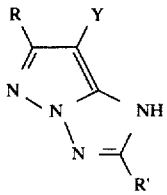

(Id)

wherein,

R represents a hydrogen atom, an aliphatic group, an aromatic group, a heterocyclic group, a carbamoyl group, a sulfamoyl group, a ureido group, a sulfamoylamino group, R'''O—, R'''C(=O)—, R'''CO(=O)—, R'''S—, R'''SO—, R'''$SO_2$—, R'''$SO_2$NH—, R'''C(=O)NH—, R'''NH—, R'''OC(=O)NH—, a halogen atom, a cyano group, or an imido group, wherein R''' represents an alkyl group, an aryl group or a heterocyclic group, and wherein said R group is optionally substituted with an alkyl group, an aryl group, a heterocyclic group, an alkoxy group, an aryloxy group, an alkenyloxy group, an acyl group, an ester group, an amido group, a carbamoyl group, a sulfamoyl group, an imido group, a ureido group, an aliphatic sulfonyl group, an aromatic sulfonyl group, an aliphatic thio group, an aromatic thio group, a hydroxy group, a cyano group, a carboxy group, a nitro group, a sulfo group or a halogen atom;

R' represents an aliphatic group, an aromatic group, a heterocyclic group, a carbamoyl group, a sulfamoyl group, a ureido group, a sulfamoylamino group, R'''O—, R'''C(=O)—, R'''CO(=O)—, R'''S—, R'''SO—, R'''$SO_2$—, R'''$SO_2$NH—, R'''C(=O)NH—, R'''NH—, R'''OC(=O)NH—, a halogen atom, a cyano group, or an imido group, wherein R''' represents an alkyl group, an aryl group or a heterocyclic group;

Y represents a hydrogen atom or a group capable of splitting off upon a coupling reaction with an oxidation product of a developing agent;

provided that a dimer or a polymer may be formed via R, Y, or R';

Formula (II)

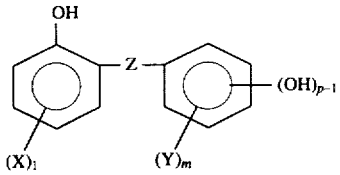

wherein,

X and Y each represent a hydrogen atom, an alkyl group, an alkoxy group, or an acyl group;

Z represents —CO— or —COO—; and m, l and p each represent an integer of 1 to 4.

2. The silver halide color photographic light-sensitive material as claimed in claim 1, wherein the coupler represented by Formula (Id) is used in an amount of $1\times10^{-3}$ mole to 1 mole per mole of silver halide.

3. The silver halde color photographic light-sensitive material as claimed in claim 1, wherein the compound represented by Formula (II) is used in an amount of 1 to 300% by weight based on the coupler of Formula (Id).

4. The silver halide color photographic light-sensitive material as claimed in claim 1, wherein silver chlorobromide containing substantially no silver iodide and having a silver chloride content of 90 mol % or more, or a pure silver chloride is used in the silver halide emulsion.

5. The silver halide color photographic light-sensitive material as claimed in claim 1, wherein the substituents represented by R and R' each represent:

an aliphatic group having 1 to 36 carbon atoms, which is a straight chain alkyl group, a branched chain alkyl group, a cycloalkyl group or an alkenyl group, an aromatic group which is a phenyl group or a naphthyl group, a heterocyclic group having a nitrogen-containing 5- or 6-membered ring group, a carbamoyl group, a sulfamoyl group, a ureido group, or a sulfamoylamino group, wherein a hydrogen atom on said R and R' groups is optionally substituted with a substituent which is an alkyl group, an aryl group, a heterocyclic group, an alkoxy group, an aryloxy group, an alkenyloxy group, an acyl group, an ester group, an amido group, a carbamoyl group, a sulfamoyl group, an imido group, a ureido group, an aliphatic sulfonyl group, an aromatic sulfonyl group, an aliphatic thio group, an aromatic thio group, a hydroxy group, a cyano group, a carboxy group, a nitro group, a sulfo group, or a halogen atom.

6. The silver halide color photographic light-sensitive material as claimed in claim 1, wherein the substituents represented by R and R' represent:

a substituted or unsubstituted aliphatic group having 1 to 36 carbon atoms, and which is a straight chain alkyl group, a branched chain alkyl group, a cycloalkyl group or an alkenyl group, wherein said substituted aliphatic group is an aliphatic group which is substituted by a substituent which is an alkyl group, an aryl group, a heterocyclic group, an alkoxy group, an aryloxy group, an alkenyloxy group, an acyl group, an ester group, an amido group, a carbamoyl group, a sulfamoyl group, an imido group, a ureido group, an aliphatic sulfonyl group, an aromatic sulfonyl group, an aliphatic thio group, an aromatic thio group, a hydroxy group, a cyano group, a carboxy group, a nitro group, a sulfo group or a halogen atom.

7. The silver halide color photographic light-sensitive material as claimed in claim 1, wherein:

Y is a group capable of splitting off upon a coupling reaction with an oxidation product of a developing agent and comprises:

an aliphatic group, an aromatic group, a heterocyclic group, an aliphatic sulfonyl group, an aromatic sulfonyl group, a heterocyclic sulfonyl group, an aliphatic oxycarbonyl group, an aromatic oxycarbonyl group, an aliphatic carbamoyl group, an aromatic carbamoyl group, an aliphatic carbonyl group, an aromatic carbonyl group, a heterocyclic carbonyl group or an imido group, an oxygen atom, a nitrogen atom or a sulfur atom which connects to a coupling active carbon atom, a halogen atom, or an aromatic azo group; and each of said aliphatic group, aromatic group or heterocyclic group is unsubstituted or is substituted by a substituent which is an alkyl group, an aryl group, a heterocyclic group, an alkoxy group, an aryloxy group, an alkenyloxy group, an acyl group, an ester group, an amido group, a carbamoyl group, a sulfamoyl group, an imido group, a ureido group, an aliphatic sulfonyl group, an aromatic sulfonyl group, an aliphatic thio group, an aromatic thio group, a hydroxy group, a cyano group, a carboxy group, a nitro group, a sulfo group or a halogen atom.

8. The silver halide color photographic light-sensitive material as claimed in claim 1, wherein R is a tertiary alkyl group.

9. The silver halide color photographic light-sensitive material as claimed in claim 1, wherein:

R is said aliphatic group and is selected from a straight chain alkyl group, a branched chain alkyl group, a cycloalkyl group and an alkenyl group; or R is said aromatic group and is selected from phenyl and naphthyl.

10. The silver halide color photographic light-sensitive material as claimed in claim 1, wherein:

R' is said aliphatic group and is selected from a straight chain alkyl group, a branched chain alkyl group, a cycloalkyl group and an alkenyl group; or R' is said aromatic group and is selected from phenyl and naphthyl.

* * * * *